US010163297B1

(12) United States Patent
Bosak et al.

(10) Patent No.: US 10,163,297 B1
(45) Date of Patent: Dec. 25, 2018

(54) GAMING SYSTEM AND METHOD HAVING EFFICIENT GAME EVALUATIONS

(71) Applicant: ADP GAUSELMANN GMBH, Espelkamp (DE)

(72) Inventors: Wojciech Bosak, Vienna (AT); Juergen Retzer, Vienna (AT); Dennis Bernert, Vienna (AT)

(73) Assignee: ADP GAUSELMANN GMBH, Espelkamp (DE)

( * ) Notice: Subject to any disclaimer, the term of this patent is extended or adjusted under 35 U.S.C. 154(b) by 0 days.

(21) Appl. No.: 15/951,160

(22) Filed: Apr. 11, 2018

(51) Int. Cl.
*G07F 17/32* (2006.01)

(52) U.S. Cl.
CPC ..... *G07F 17/3213* (2013.01); *G07F 17/3216* (2013.01); *G07F 17/3244* (2013.01); *G07F 17/3269* (2013.01)

(58) Field of Classification Search
USPC ..... 463/43
See application file for complete search history.

(56) References Cited

U.S. PATENT DOCUMENTS

| | | | | |
|---|---|---|---|---|
| 9,710,998 | B2 * | 7/2017 | Nelson | G07F 17/3211 |
| 9,922,497 | B2 * | 3/2018 | Joung | G07F 17/326 |
| 2016/0328909 | A1 * | 11/2016 | Joung | G07F 17/326 |
| 2018/0204410 | A1 * | 7/2018 | Joung | G07F 17/326 |

* cited by examiner

*Primary Examiner* — Pierre E Elisca
(74) *Attorney, Agent, or Firm* — Resolute Legal PLLC

(57) ABSTRACT

Various embodiments of a gaming system and method are disclosed as having increased efficiency in game evaluations. The gaming system may incrementally evaluate a predetermined quantity of symbol sets for winning symbol combinations rather than evaluating all or substantially of the predetermined quantity of symbol sets at substantially the same time. The gaming system may also incrementally reveal the predetermined quantity of symbol sets to increase player anticipation of increased winnings.

20 Claims, 12 Drawing Sheets

GAMING SYSTEM AND METHOD HAVING EFFICIENT GAME EVALUATIONS

FIELD OF THE INVENTION

The present disclosure relates to gaming devices.

SUMMARY OF THE INVENTION

Various embodiments of a gaming system and method are disclosed as having increased efficiency in game evaluations. For example, the gaming system may incrementally evaluate a predetermined quantity of symbol sets for winning symbol combinations rather than evaluating all or substantially all of the predetermined quantity of symbol sets at substantially the same time. The gaming system may evaluate a first plurality of symbols in a first symbol set for winning symbol combinations. The gaming system may display and highlight any determined winning symbols or symbol combinations and display a win amount associated with the winning symbol or symbol combinations. If additional symbol sets remain unevaluated, the gaming system may evaluate a second plurality of symbols in a second symbol set. The gaming system may evaluate the second plurality of symbols with symbols in the first symbol set. The gaming system may display and highlight any determined winning symbols or symbol combinations and display a win amount associated with the winning symbol combinations from the first and second symbol sets. If additional symbols sets remain unevaluated, the gaming system may evaluate a third plurality of symbols in a third symbol set. The gaming system may evaluate the third plurality of symbols with symbols in the first symbol set and the second symbol set. The gaming system may display and highlight any determined winning symbols or symbol combinations and display a win amount associated with the winning symbols or symbol combinations based on symbols from the first, second, and third symbol sets. In some embodiments, each new win amount (e.g., win amounts based on the first plurality of symbols alone versus win amounts based on the first plurality of symbols and the second plurality of symbols) replaces the prior win amount. In alternative embodiments, each new win amount is additive with the prior win amount. In other alternative embodiments, each new win amount is multiplicative; provided however any suitable mathematic formula may be applied to determine new win amounts. The gaming system may continue to incrementally evaluate symbol sets for winning symbol combinations until all symbol sets have been evaluated. The evaluation process reduces processing loads of the gaming system, improves the responsiveness of the gaming system, and increases the speed of game play. Moreover, in some embodiments, when the gaming system has less to process at the end of a play of the game, the overall game play may end sooner and the next game can begin faster. Thus, the time between games is reduced and the overall rate of play can be increased.

In one embodiment, the gaming system includes a plurality of symbol display areas and a plurality of symbol sets. Each of the plurality of symbol sets is associated with at least one of the plurality of symbol display areas. Each of the plurality of symbol sets includes a plurality of different symbols. The gaming system randomly generates symbols for the plurality of symbol display areas from the associated plurality of symbol sets. The gaming system incrementally evaluates the generated symbols for winning symbols or symbol combinations.

In one such embodiment, during a play of a game, the gaming system randomly generates one or more first symbols from a first symbol set of the plurality of symbol sets. The gaming system displays the generated one or more first symbols in an associated first symbol display area of the plurality of symbol display areas. The gaming system evaluates the generated one or more first symbols for a winning symbol or winning symbol combinations. For example, the gaming system evaluates if at least one predetermined winning symbol was generated for the first symbol display area. The gaming system highlights any determined winning symbols or symbol combinations based on a pay table and displays a win amount associated with the winning symbols or symbol combinations.

If the gaming system determines that additional symbol display areas remain without generated symbols, the gaming system randomly generates one or more second symbols from a second symbol set of the plurality of symbol sets. The gaming system evaluates the generated one or more second symbols for winning symbols or winning symbol combinations with the one or more first symbols generated for the first symbol display area. The gaming system highlights any determined winning symbols or symbol combinations based on the pay table and displays any appropriate new win amount associated with the winning symbols or symbol combinations. If the gaming system determines that additional symbol display areas remain without generated symbols, the gaming system randomly generates one or more third symbols from a third symbol set of the plurality of symbol sets. The gaming system evaluates the generated one or more third symbols for winning symbols or winning symbol combinations with the one or more first symbols generated for the first symbol display area and with the one or more second symbols generated for the second symbol display area. The gaming system highlights any determined winning symbols or symbol combinations based on the pay table and displays any appropriate new win amount associated with the winning symbols or symbol combinations.

In some embodiments, if the gaming system does not detect a win, the gaming system does not highlight additional symbols or display a new win amount. In one such embodiment, the gaming system may continue to display the prior win amount. If the gaming system determines that no additional symbol display areas remain without generated symbols, the play of the game ends and the gaming system provides the last new win amount to the player.

It should be appreciated that the gaming system may randomly generate symbols for all of the symbol display areas at substantially the same time, but incrementally evaluate the generated symbols for each symbol display area as discussed above. In other embodiments, the gaming system may randomly generate symbols for all of the symbol display areas at substantially the same time and also evaluate the generated symbols for winning symbol combinations prior to displaying any generated symbols to a player. In one such embodiment, the gaming system may incrementally display symbols for each symbol display area and highlight winning symbols as if winning symbols for a symbol display area are revealed even though winning calculations have already been performed.

In one embodiment, the gaming system includes a slot machine having a plurality of reels (e.g., five reels). The reels can be implemented as mechanical reels or virtual reels (e.g., virtual video reels) as discussed herein. Each reel in the gaming system is associated with a symbol set of a plurality of different symbols. In one embodiment, the gaming system may randomly generate and display three symbols for each reel during a play of a game; however the gaming system can be configured to generate and display any suitable number of symbols. In one embodiment, the gaming system incrementally evaluates and displays the generated symbols, one reel at a time, to determine if the gaming system generated winning symbol combinations for the reels. For example, the gaming system may evaluate and display generated symbols on a first reel. The gaming system may then evaluate and display generated symbols on a second reel, which will also be evaluated with certain symbols on the first reel. The gaming system may then evaluate and display generated symbols on a third reel, which will also be evaluated with certain symbols on the first reel and the second reel. The gaming system continues this incremental evaluation, by adding one reel to the evaluation process for each evaluation cycle, until all of the reels have been evaluated. The gaming system may display winning outcomes as each reel is evaluated.

As another example, during a play of a reel game, the gaming system activates all of the displayed reels such that all of the reels are spinning. The gaming system randomly generates and displays symbols on a first reel. The gaming system stops the first reel from spinning to display the generated symbols for the first reel. The gaming system evaluates the generated symbols on the first reel for any winning symbols in accordance with a pay table. The gaming system highlights any determined winning symbols based on the pay table. The gaming system may display a win amount associated with any winning symbols. In one embodiment, the gaming system flashes the win amount in the center of a display screen of the gaming system over the reels. In an alternative embodiment, the gaming system displays the win amount in a win meter. The gaming system may also flash or highlight the win amount in the win meter.

The gaming system determines if any reels are still active (e.g., still spinning). If the gaming system determines that at least one reel is still active, the gaming system randomly generates and displays symbols on a second reel. The gaming system stops the second reel from spinning to display the generated symbols for the second reel. The gaming system evaluates the generated symbols on the second reel with the first reel for any winning symbols or winning symbol combinations in accordance with the pay table. The gaming system highlights any determined winning symbols or symbol combinations based on the pay table. The gaming system may display a win amount associated with any winning symbols or symbol combinations.

The gaming system then determines if any reels are still active (e.g., still spinning). If the gaming system determines that a reel is still active, the gaming system randomly generates and displays symbols on a third reel. The gaming system stops the third reel from spinning to display the generated symbols for the third reel. The gaming system evaluates the generated symbols on the third reel with the first reel and second reel for any winning symbols or winning symbol combinations in accordance with the pay table. The gaming system highlights any determined winning symbols or symbol combinations based on the pay table. The gaming system may display a win amount associated with any winning symbols or symbol combinations.

The gaming system then determines if any reels are still active (e.g., still spinning). If the gaming system determines that a reel is still active, the gaming system randomly generates and displays symbols on a fourth reel. The gaming system stops the fourth reel from spinning to display the generated symbols for the fourth reel. The gaming system evaluates the generated symbols on the fourth reel with the first reel, second reel, and third reel for any winning symbols or winning symbol combinations in accordance with the pay table. The gaming system highlights any determined winning symbols or symbol combinations based on the pay table. The gaming system may display a win amount associated with any winning symbols or symbol combinations.

The gaming system then determines if any reels are still active (e.g., still spinning). If the gaming system determines that a reel is still active, the gaming system randomly generates and displays symbols on a fifth reel. The gaming system stops the fifth reel from spinning to display the generated symbols for the fifth reel. The gaming system evaluates the generated symbols on the fifth reel with the first reel, second reel, third reel, and fourth reel for any winning symbols or winning symbol combinations in accordance with the pay table. The gaming system highlights any determined winning symbols or symbol combinations based on the pay table. The gaming system may display a win amount associated with any winning symbols or symbol combinations. The gaming system determines if any reels are still active (e.g., still spinning). If the gaming system determines that no reels remain active, the gaming system provides the final win amount to the player.

While gaming system in the foregoing example randomly generates symbols for each subsequent reel after the prior reel was generated, evaluated, and displayed, in alternative embodiments, the gaming system may randomly generate symbols for some or all of the reels at the same or substantially the same time at the beginning of the game. In still other embodiments, the gaming system may randomly generate the symbols for the reels at any suitable time.

In some embodiments, each new win amount obtained when a reel has stopped replaces the prior win amount such that the player retains only the latest new win amount. In alternative embodiments, each new win amount is additive with the prior win amount and the gaming system provides each win amount to the player.

It should be appreciated that a gaming system and method with incremental evaluation of symbol sets for winning symbol combinations increases the hardware efficiency of the gaming system. For example, processors of the gaming system process smaller quantities of data (e.g., evaluating symbols on each reel as the symbols are revealed) rather than processing all of the reels at once. The gaming system also does not need to load the entire set of generated symbols into memory at one time to perform a win evaluation, which reduces the amount of system memory that gaming system uses for a play of the game.

Moreover, a gaming system and method with incremental evaluations of symbol sets for winning symbol combinations also builds a new sense of anticipation for a player as win amounts and quantities of winning symbols are accumulated over time. As a player obtains winning symbols and reels remain active, the gaming system provides the player a greater sense of anticipation that each reel that remains active may produce a larger win and add to the players existing winnings.

BRIEF DESCRIPTION OF THE DRAWINGS

FIGS. 4A, 4B, 4C, 4D, 4E, and 4F illustrate screen shots of one embodiment of a gaming system comprising incremental evaluations of symbol sets for winning symbol combinations.

DETAILED DESCRIPTION OF THE INVENTION

Figure 1:
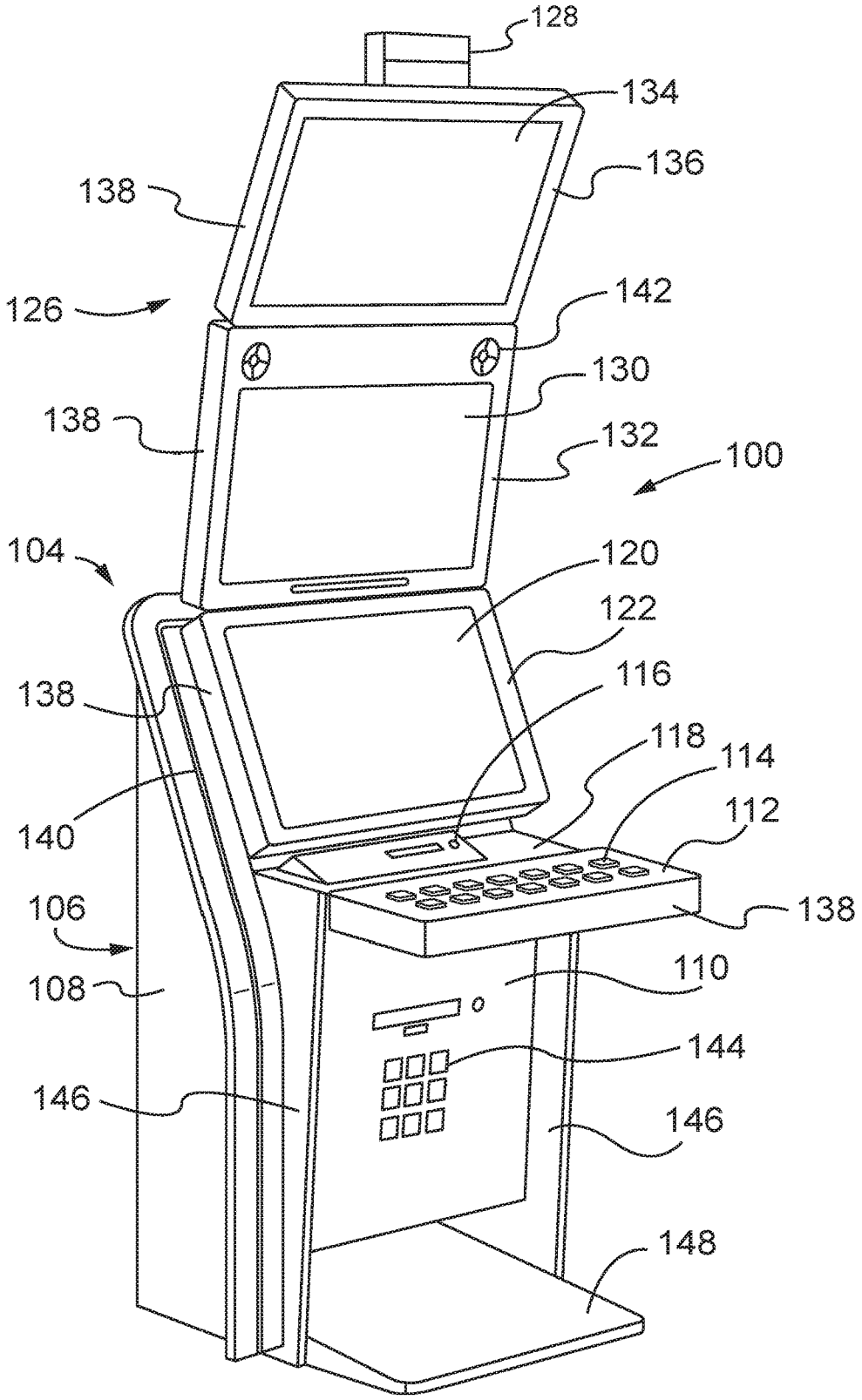
FIG. 1 is a perspective view of one embodiment of a stand-alone gaming device of a gaming system.

Various embodiments of a gaming system and method are disclosed as having incremental evaluation of symbols in different symbol sets for increased evaluation efficiency.

For example, the gaming system may incrementally evaluate a predetermined quantity of symbol sets for winning symbol combinations rather than evaluating all or substantially all of the predetermined quantity of symbol sets at substantially the same time. The gaming system may evaluate a first plurality of symbols in a first symbol set for winning symbol combinations. The gaming system may display and highlight any determined winning symbols or symbol combinations and display a win amount associated with the winning symbol or symbol combinations. If additional symbol sets remain unevaluated, the gaming system may evaluate a second plurality of symbols in a second symbol set. The gaming system may evaluate the second plurality of symbols with symbols in the first symbol set. The gaming system may display and highlight any determined winning symbols or symbol combinations and display a win amount associated with the winning symbol combinations from the first and second symbol sets. If additional symbols sets remain unevaluated, the gaming system may evaluate a third plurality of symbols in a third symbol set. The gaming system may evaluate the third plurality of symbols with symbols in the first symbol set and the second symbol set. The gaming system may display and highlight any determined winning symbols or symbol combinations and display a win amount associated with the winning symbols or symbol combinations based on symbols from the first, second, and third symbol sets. In some embodiments, each new win amount (e.g., win amounts based on the first plurality of symbols alone versus win amounts based on the first plurality of symbols and the second plurality of symbols) replaces the prior win amount. In alternative embodiments, each new win amount is additive with the prior win amount. In other alternative embodiments, each new win amount is multiplicative; provided however any suitable mathematic formula may be applied to determine new win amounts. The gaming system may continue to incrementally evaluate symbol sets for winning symbol combinations until all symbol sets have been evaluated. The evaluation process reduces processing loads of the gaming system, improves the responsiveness of the gaming system, and increases the speed of game play. Moreover, in some embodiments, when the gaming system has less to process at the end of a play of the game, the overall game play may end sooner and the next game can begin faster. Thus, the time between games is reduced and the overall rate of play can be increased.

Gaming Device Platform

The features and advantages of the gaming system and method described herein may be provided to a player via a gaming device platform that includes various structures and components for allowing player interaction with the gaming device. While only one gaming device platform will be described in detail herein, the features, objects, and advantages of the gaming system described herein may be implemented in one or more alternative gaming device platforms.

One embodiment of a gaming device platform is shown in FIG. 1 where a gaming device 100 is generally shown. In one embodiment, the gaming device 100 is referred to as a slot machine and is illustrated as housed in a housing or cabinet constructed so that a player can operate and play the gaming device 100 while standing or sitting.

Gaming device 100 may include cabinet 104 for housing the components fully described hereinbelow. The cabinet 104 has a lower cabinet body portion 106 which includes a pair of cabinet side panels 108 (only one of which is viewable in the perspective view of FIG. 1), front panel 110, and a rear panel (not shown). A base panel (not shown) and a top panel surface (not shown) that supports first game display 120 and the player interaction area 112, are provided. The cabinet panels are interconnected along their edges and cooperate to form a cabinet enclosure for housing the gaming device, as can be seen in FIG. 1.

It should be appreciated that a wide variety of cabinet enclosure sizes, shapes, and designs are possible for the gaming device 100. Cabinet 104 may function to securely protect any local control system, technology components, and provide support for game display(s) and player input and output interactions with the gaming device.

Returning to FIG. 1, the gaming device enables the player to interact with the gaming device 100 to direct the wagering and game play activities and preferences. Various forms of player interaction devices and activities will now be described.

Cabinet 104 includes a player interaction area having input and output areas generally designated as 112. The player interaction area 112 may be located on the front top side of cabinet 104 and, as shown, on a panel structure that extends outwardly from the gaming device in a player's direction. Player interaction area 112 may contain a plurality of player input and output structures such as player control button area 114, player value acceptor and dispenser area 116, and player convenience input area 118.

Player control button area 114 includes a plurality of buttons, touch sensitive areas, or both through with which players may interact with the one or more processors of gaming device 100 and direct game play. It is expected that cabinet 104 provides an easily accessible location and support for all necessary player input/output (I/O) interactions with the device, including gaming control interactions and value wagering interactions. Although the gaming device 100 illustrated in FIG. 1 shows player controls provided by buttons of player control button area 114, it is understood that in one embodiment, a player's gaming control interactions could be made by either buttons mounted on cabinet 104 or "soft" buttons located on the gaming display and activated by player touch (e.g., touch screen interfaces), or a combination of both arrangements.

Player control button area 114 may include, for example: game selection button(s) in any embodiments where more than one game is provided in a single gaming device; gaming denomination value selection button(s) in any embodiments where one or more wagering denomination value is accommodated; wager selection button(s) for the player to indicate or select the desired wager value for a game in any embodiments where a selection of wager values are offered; pay line selection button(s) for selecting the number of active pay lines in game embodiments that provide multiple pay line wagering; a reel spin button for players to initiate one or more reels to spin in a game; a repeat last bet button for players to conveniently repeat the last game's preference and wager selections in a new game; a cash-out button for player extraction of gaming device credits; an attendant call button; and gaming device information buttons such as show pay tables, show game rules, or show other game-related information. As discussed above, the functions of the buttons in player control button area 114 may be duplicated with soft buttons in the player control button area 114 or as soft buttons in other areas of the gaming device 100 (e.g., as a touch screen overlay over available game displays).

Gaming device 100 may include one or more forms of value acceptance and value distribution to allow the player to interact with the device and to risk or otherwise place a wager (a monetary value) on one or more outcomes of a game. Winnings may be returned to the player via some form of value distribution. As illustrated in FIG. 1, player value acceptor and dispenser area 116 is provided. In the player value acceptor and dispenser area 116, a player supplies monetary value to the gaming device 100 via one or more value acceptor devices. In one embodiment, the player value acceptor and dispenser area 116 (through the one or more value acceptor devices) may accept any one or more of the following from a player to establish a gaming credit balance: coins, bills, tokens, tickets/vouchers, player ID cards, credit cards, or other suitable forms of value. Thus, if the gaming device 100 accepts coins and bill, the gaming device 100 includes a currency bill validator and a coin validator as the value acceptor devices. Likewise, if the gaming device 100 accepts tickets, the gaming device includes a ticket acceptor as a value acceptor device for receiving tickets or vouchers representing some monetary value. The ticket acceptor may include a bar code reader, or other appropriate code reader, for reading the encoded value contained by the player's ticket or voucher. In some embodiments, the player value acceptor and dispenser area 116 may include a value acceptor device that can accept more than one type of value. In some embodiments, the player value acceptor and dispenser area 116 may include multiple different value acceptor devices to accept different types of value from players Upon receipt of some type of value from the player, a value acceptor device of the player value acceptor and dispenser area 116 performs validation on the player supplied value using appropriate hardware readers (e.g., determining that the currency bills/coins/tokens are genuine or the ticket/voucher is genuine). If the validation result is positive on player supplied value, the appropriate value acceptor device generates a signal to a processor of the gaming device 100 to establish a gaming credit balance for plays of one or more games on gaming device 100.

In one embodiment, a player receives monetary value, or a representation thereof, from the gaming device 100 when a player chooses to "cash out" the gaming credit balance (e.g., remove value from the gaming device 100). The player can cash out at any suitable time. When a player cashes out the value contained on a credit meter (not shown) of gaming device 100, a processor of gaming device 100 may cause a printer of gaming device 100 to print and dispense a coded ticket or voucher through a dispensing slot to the player. The coded ticket or voucher may be a bar-coded ticket or any other suitable code (PDF417 coding or quick response (QR) coding). This ticket can then be used as value input at another gaming device, or converted to currency at a conveniently located kiosk or cashier counter located near the gaming device. Alternatively, the processor of gaming device 100 may cause a currency bill dispenser or a coin dispenser in gaming device 100 to dispense the value contained on the credit meter of gaming device 100.

Various combinations of the above value acceptance and value distribution arrangements are possible. Gaming device 100 may include other value acceptance and value distribution mechanisms in the player value acceptor and dispenser area 116. For example, gaming device 100 may include a magnetic strip or chip card reader/writer in order to accept value from and transfer value to a magnetic strip or an embedded chip card. In other embodiments, hardware for transferring (and receiving) non-traditional currencies to players such as digital currencies (e.g., bitcoin) may be included in gaming device 100.

In an alternative embodiment, gaming device 100 may include a card reader (not illustrated) in the in the player value acceptor and dispenser area 116, which accepts and reads any of a variety of magnetic strip or imbedded chip smart cards that convey machine readable information. The card reader reads inserted cards, in the case of wagering, for the credit information of the player for cashless gaming. The card reader may, for player loyalty programs, utilize the information on the card to identify the player account associated with the card so the gaming activity on the gaming device may be associated with the player account. It is noted that a numeric or alphanumeric keypad may be provided adjacent to the card reader slot to enable player entry of a personal identification number or the like for secure access to card information.

In one embodiment, a player convenience input area 118 may be included in the gaming device 100, as is shown in FIG. 1. In various embodiments, player convenience input area 118 may have a variety of features and functions depending on the jurisdictional deployment of the gaming device 100. In one embodiment, the player convenience input area 118 will house a magnetic strip card reader (not illustrated), integrated circuit chip card reader (not illustrated), or both, for reading cards associated with a player loyalty program. Player loyalty programs, also referred to as player tracking systems, provide magnetic strip or chip cards to players for insertion into a gaming device during play. These player loyalty/player tracking cards are associated with a player account and are utilized by the card-issuing entity to monitor, or track a player's gaming activity and build loyalty through player rewards of a variety of types. The player convenience input area 118 may include an input mechanism such as input buttons so that a player may input a personal identification number or other require player information associated with the player tracking card. Further, the input mechanism may also include a small display utilized to communicate player information to the player such as the player's current loyalty rewards.

In certain embodiments, the player convenience input area 118 may include player convenience features such as a pocket for storage that allows players to store their personal items such as a mobile phone. Gaming device 100 may include one or more universal serial bus (USB) ports that enables a player to charge their electronics or connect to services such as the Internet or food service. Further, player convenience input area 118 of gaming device 100 may include buttons to request food or drink service if the gaming device is located in an establishment that has food and drink service. The gaming device 100 may be connected to a local or wide area network such that selection of the requested food or drink service will alert the establishment's hospitality staff to deliver the requested service directly to the gaming device 100.

The layout of the player control button area 114, player value acceptor and dispenser area 116 and the player convenience input area 118 in gaming device 100 may be arranged differently than those disclosed and illustrated herein. The selections and arrangement of input locations on the cabinet 104 may be dependent upon the game buttons, the type of value wagered, and the player conveniences utilized in the deployment configuration of gaming device 100.

With continuing reference to FIG. 1, in one embodiment, lower cabinet body portion 106 includes a first game display 120 mounted atop or flush with the lower cabinet body portion's top panel surface. First game display 120 is, for example, a 27-inch liquid crystal display (LCD) display mounted in a widescreen orientation. However, any suitable display may be used in any suitable orientation. In the illustrated embodiment, the first game display 120 is mounted within and framed by first display frame 122 which is, in turn, mounted upon lower cabinet body portion's top panel surface. In this manner, the first game display 120 is both surrounded and secured within the first display frame 122 and raised above the cabinet's top panel surface. Additional features of the first display frame 122 will be described below. In one embodiment, gaming device 100 may use one first game display 120 and not include additional game displays (not illustrated).

The lower cabinet body portion 106 is further constructed to support upper cabinet portion 126. Upper cabinet portion 126 may be comprised of an upwardly extending support structure (not illustrated) that extends upwardly from the rear side of lower cabinet body portion 106 and is sufficiently strong to support one or more additional game displays.

At the topmost end of the support structure, a cabinet top light 128 may be provided. The cabinet top light 128 is capable of illumination in a variety of colors and is utilized to indicate and communicate gaming device conditions to gaming players and service personnel.

Further, the upper cabinet portion support structure may conceal power and communication lines between (1) the control systems and components located within the lower cabinet body portion 106 and (2) the displays mounted on the upper cabinet portion 126 support structure.

In one embodiment, as illustrated in FIG. 1, gaming device 100 includes two additional displays, second game display 130 and third game display 134. Second game display 130 and third game display 134 are disposed generally in a vertical relationship and generally in alignment with the first game display 120. Like the first game display 120, second game display 130 and third game display 134 can be 27-inch LCD displays and can be mounted in a widescreen orientation in one embodiment. However, any suitable display in any suitable orientation may be used for the second game display 130 and the third game display 134. Further, like the first game display 120, second game display 130 and third game display 134 can be mounted within and framed by second display frame 132 and third display frame 136, respectively. Second display frame 132 and third display frame 136 are attached to the upper cabinet support structure and can protect the second game display 130 and the third game display 134.

First game display 120, second game display 130, and third game display 134 can be disposed at an angle from each other to form a player-facing concave arc. However, in some embodiments, the angles between the displays may be adjustable and may be smaller or greater than the angles illustrated in FIG. 1. Further, it is understood that in some embodiments the displays may be disposed in a common plane relative to each other.

It also should be appreciated that in various embodiments a variety of display technology may be utilized equivalently and interchangeably with a variety of embodiments of the gaming device. Equivalent display devices include all variations of liquid crystal displays, light emitting diode displays, and plasma displays.

In some embodiments, different sized displays may be combined to display gaming data on gaming device 100. As a non-limiting example, a 27-inch widescreen LCD display may be combined with a 20-inch portrait oriented LCD or a light emitting diode (LED) display. This combination may be used, for example, with a third scrolling banner LED display. In alternative embodiments, one, two, three, or more displays could be used in a variety of positions and orientations. Any suitable combination may be used. It should also be appreciated that a processor of gaming device 100 may communicate with the disclosed first game display 120, second game display 130, and third game display 134 through a video card of gaming device 100 to produce the visible aspects of a game.

In one embodiment, one or more of the first game display 120, second game display 130, and third game display 134 may be fitted with a transparent touch sensitive overlay for sensing player touch inputs into the gaming device. Touch sensitive overlays can communicate with a processor of gaming device 100 to enable the player to interact with the game.

In some embodiments, the curved displays may be used for any or all of the first game display 120, second game display 130, or third game display 134. Similarly, any of the displays used for gaming device 100 can be based on flexible display technologies. For example, it is possible to utilize flexible display technologies to create uniquely shaped curving, wavy, or tubular display structures to provide one or more of the first game display 120, second game display 130, and third game display 134. Additionally, in one embodiment flexible display technologies can be used in combination with fixed flat screen technologies.

While the gaming device 100 has been described as implemented with video technologies, in one embodiment, mechanical reels with reel strips containing game indicia and step motor controllers may be employed to provide game information to a player. In one embodiment, the reel strips may include a plurality of printed symbols. In another embodiment, the mechanical reels may include flexible video display technology as the reel strips on mechanical reels. Thus, games implemented in video form can readily be implemented with mechanical reels utilizing such display technology. Alternatively, in other embodiments mechanical reels with reels strips having fixed symbols displayed along the reel strip could be used to implement the game.

Dependent upon the particular gaming device housing style, a variety of other display technologies may be utilized in combination with the gaming device disclosed herein. For example, in some embodiments a gaming device may have one or more display devices in addition to the main game display(s). For example, the gaming device may include a player tracking device having a player tracking display which displays various information to the player regarding the player's status. The gaming device may also include other game-related displays such as the wager display and the gaming credit balance display. These additional game-related displays may be separate display devices or may be displayed on any one or more of the first game display 120, the second game display 130, or the third game display 134.

Cabinet lighting design functions to attract players to a gaming device 100. In the embodiment of FIG. 1, attractive cabinet lighting is provided by frame accent lighting 138. It is noted that frame accent lighting 138 is a common structure found on each of the first display frame 122, the second display frame 132, and the third display frame 136 and player interaction area 112. Example areas where frame accent lighting is applied to gaming device 100 are commonly designated as frame accent lighting 138.

Frame accent lighting 138 may have multiple components. The side edge pieces of first display frame 122, second display frame 132, third display frame 136, and the edge structure of player interaction area 112 can be made of a translucent or transparent plastic or other suitable materials. Linear arrays, or strips, of light emitting diodes (LEDs) (not shown) on circuit boards may be mounted below the translucent or transparent plastic side edge pieces 138. In one embodiment, the circuit boards are flexible circuit boards. These LED strips and transparent or translucent coverings may surround one or more gaming device displays frames, as well as the player interaction area, to highlight these areas.

In one embodiment, the individual LEDs mounted on the LED strips are of a type that can emit red, green, and blue light. In an alternative embodiment, separate LEDs are used for each required light color. All LED strips can be electrically connected and can be controlled by a cabinet lighting controller 218 (illustrated in FIG. 2) in conjunction with a processor of gaming device 100 to selectively mix the emitted light colors in a manner to create any color. The cabinet lighting controller 218 can flash and vary lighting as desired. For example, cabinet edge lighting can change and flash in combination with music rhythms or in combination with game events. Other variations are possible.

In some embodiments, cabinet 104 may include LED strip lighting or LED rope lighting to accentuate the cabinet and enhance the attractiveness of gaming device 100 to players. LED rope lighting is a plurality of small light-emitting diode bulbs linked together and encased in a plastic, polyvinylchloride, or other suitable material to create a string of lights. For example, in the embodiment of FIG. 1, cabinet 104 includes cabinet accent lighting 140. In one embodiment, cabinet accent lighting 140 is LED rope lighting mounted flush with the front side edge of the cabinet side panels 108. The LED rope lighting can generate any of suitable colors, and are controlled by cabinet lighting controller 218 and a processor of gaming device 100 to selectively mix the emitted light colors in a manner to create any color in the same manner as the frame edge lighting.

In various embodiments, gaming device 100 includes one or more audio speakers and appropriate driving electronics and sound cards so that game players may experience pleasing audio aspects of the gaming device 100. Audio is desirable to attract and maintain player interest in gaming device 100. Gaming device 100 may also emit attraction sounds during any idle period of gaming device 100. Game audio may add to the player's enjoyment of gaming device 100 by providing music and sound effects designed to enhance and compliment the gaming experience.

Audio speaker hardware may include one or more speakers disposed in or on the cabinet 104 of gaming device 100. In FIG. 1, a pair of audio speakers 142 are shown mounted on the upper corners of second display frame 132. Any suitable number of additional speakers may be provided on additional display frames or on the lower cabinet body portion 106 as desired.

Speakers designed for emitting bass vibrations may be included in some embodiments. Speaker placement may be selected to enhance the sound emitting characteristics of the gaming device. For example, bass speakers or additional speakers 144 may be mounted inside lower cabinet body portion 106. Further, it is envisioned that in some embodiments sound processing such as multichannel processing and surround sound processing are included in gaming device 100. Audio jacks for attachment of player headphones may also be provided in some embodiments of gaming device 100 for the player to further enhance the audio experience of the game and also to block out noise from other gaming devices.

In one embodiment, front panel 110 of lower cabinet body portion 106 includes a locked removable panel or locked door (not shown), which can be opened for access to internal control system and technology components that are housed within lower cabinet body portion 106 (discussed hereinbelow with respect to FIG. 2). Front panel 110 may be flanked on vertical sides by cabinet side panel extensions 146 which serve to define a space below player interaction area 112 for players to place their feet and legs while they are playing gaming device 100 in a seated position. Foot rest 148, which may be cushioned, is provided below player interaction area 112 to enhance a player's ergonomic comfort while playing gaming device 100. In one embodiment, the edges of player interaction area 112 may be ergonomically cushioned as well.

Gaming device 100 may be embodied in alternative gaming device housing forms and styles. For example, the housing may have fewer or greater number of display areas for displaying the game and game-related information to the player. If multiple displays are used, the displays may be of similar size, shape, and orientation or the displays may be divergent from each other in one or more of their respective descriptive characteristics. The one or more displays can be supported by, mounted upon, or housed within a cabinet 104 which can comprise a variety of shapes, sizes, and forms. The cabinet 104 can 1) protect and house the operational electronics, 2) adequately support the display(s) in a position easily viewable for a seated or standing player, as necessary 3) provide an easy location and support for all necessary player input/output (I/O) interactions, including gaming control interactions and value wagering interactions. For example, in some embodiments the gaming device 100 may be disposed in a housing style referred to as a "slant top" gaming device that is designed to be operated with the player comfortably seated. In this arrangement, generally, the gaming display(s) and all player I/O controls are located on a low, wide, surface that extends forwardly from the player on a horizontal plane and then slopes upwardly and away from the player's seated location.

In one embodiment, housing styles of cabinet 104 of gaming device 100 may include bar top or table top housing arrangements. These housings are generally small enough to be placed on top of an existing bar or table while providing the requisite gaming device housing functions of protection of/access to gaming electronics, displays, and player I/O functions described above.

In one embodiment, cabinet 104 may be an embedded housing. Embedded housings are built into structures designed to otherwise function as bars or tables in a gaming environment. Displays may be integral with the bar top or table top surface or the entire unit may be contained below a transparent bar or table top surface while controls are disposed on the lower front or side of the bar or table.

Figure 2:
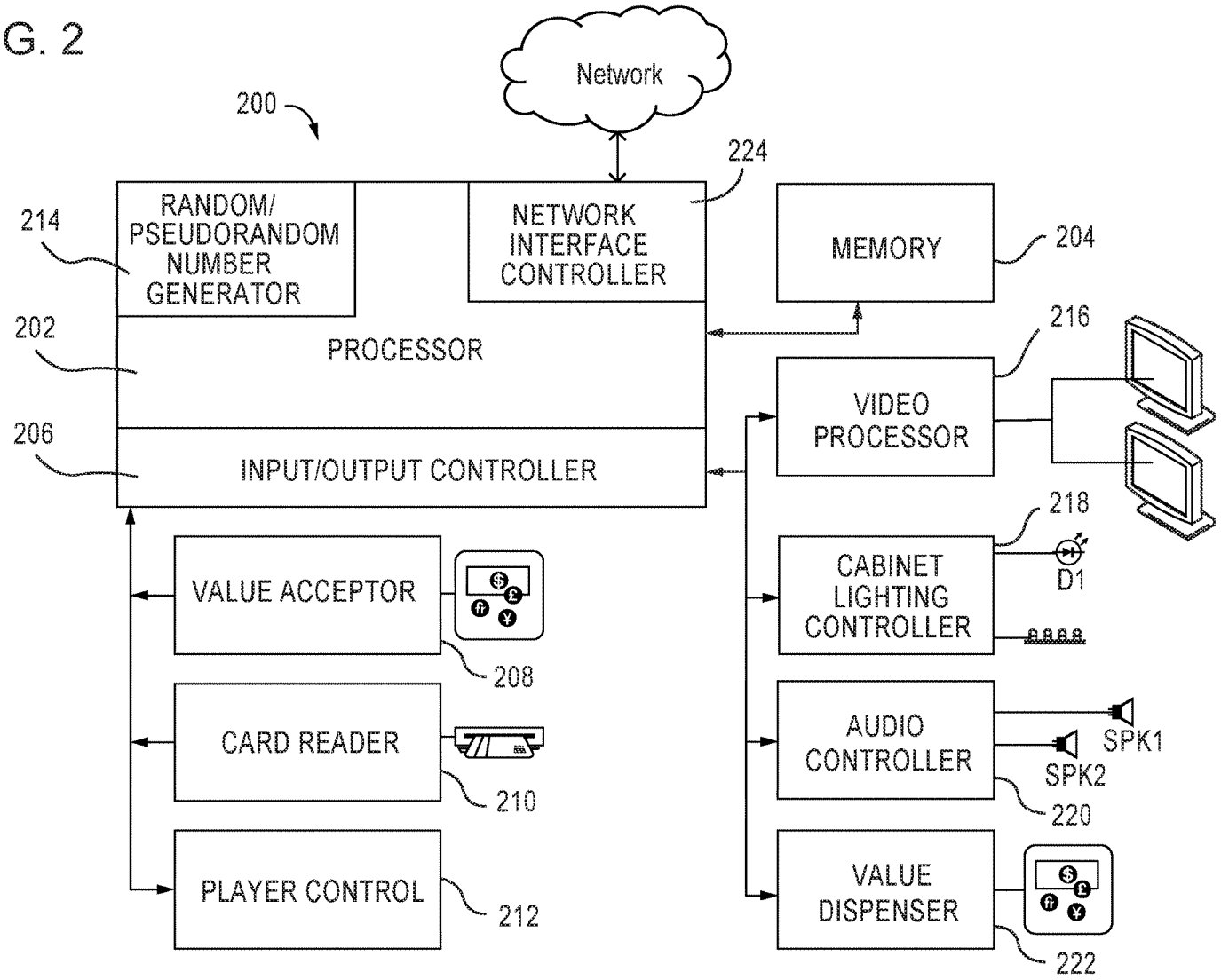
FIG. 2 is a functional block diagram of the gaming device technology components of the gaming system.

Turning now to FIG. 2, the features and advantages of the gaming system described above will now be described in terms of the various technology components for allowing player interaction with the gaming device 100.

FIG. 2 illustrates a functional block diagram of an embodiment of technology components of gaming device 100 that are specially configured to carry out the game function and operations described herein. The functional elements shown in FIG. 2 cooperate, on a broad and general level, to function as gaming device 100. The subject matter and functional operations described in relation to FIG. 2 can be embodied in hardware, software, or a combination thereof. Described hardware includes the structures described and their functional or operational equivalents. Described functions may be performed by hardware, digital circuitry, computer software, computer firmware, or functionally equivalent combinations thereof.

In one embodiment, gaming device 100 is functionally controlled by control unit 200. Control unit 200 is specifically configured and functions to perform all aspects of operations for providing the game. Control unit 200 includes at least one specially configured processor and at least one controller configured to operate with at least one memory device and at least one data storage device, at least one input device, and at least one output device. In one embodiment, control unit is also configured to communicate with a server device through a network.

In one embodiment, control unit 200 includes at least one specially configured processor 202 or central processing unit (CPU). In one embodiment, specially configured processor 202 include arithmetic logic units and math co-processors also known as floating point units. In one embodiment, specially configured processor 202 includes registers for holding instructions or other data, and cache memory for storing data for faster operation thereupon. In one embodiment, specially configured processor 202 may be a multi-core processor that includes two or more processors for enhanced performance, more efficient parallel processing, or other advantageous computing functions. In another embodiment, specially configured processor 202 may be one or more processing devices such as microprocessor(s) or integrated circuit(s) and may include one or more controllers. It should be appreciated that in some embodiments, a general purpose processor could be programmed to perform the functions of specially configured processor 202.

A controller, in one embodiment, is a device or a software program that manages or directs the flow of data between two entities. Often, controllers are special purpose circuitry or software that solve a technical communications problem between different technology systems. In one embodiment, a controller functions as an interface between two systems while managing the communications between the systems. In another embodiment, a controller functions as an interface between a processor and a peripheral device and functions to control the peripheral device.

At least one specially configured processor 202 or controller of control unit 200 is specially configured to communicate with at least one memory device, generally shown as memory device 204 in FIG. 2. In one embodiment, memory device 204 includes one or more memory structures for storing instructions and various types of game data. Memory structures include one or more random access memory units (RAMs) units, one or more read only memory units (ROMs), one or more flash memory units including solid state drives (SSDs), one or more electrically erasable/programmable read only memory units (EEPROMs).

It should be appreciated that in one embodiment, communication with a memory device by a processor or a controller encompasses the processor or controller accessing the memory device, exchanging data with the memory device, or storing data to the memory device.

Memory device 204 may store all program code and game code (collectively the "code"), and operation data necessary for the operation of the gaming device 100 and execution of the gaming features described hereinbelow. In an alternative embodiment, game code and operation data necessary for the operation of the gaming device 100 may be store in a distributed manner such that some code is stored in memory device 204 and other code is stored remotely from gaming device 100. In one embodiment, the code and operation data necessary for the operation of the gaming device includes, for example, basic input and output function data, instruction fetching data, bus and network communication protocol data, and like data necessary for an operational gaming device 100. In one embodiment, the code and operation data necessary for the execution of the gaming features includes, for example, game image data, game rule data, pay table data, game mode and timing data, gaming value and wager parameter data, and random or pseudo-random number generation data.

In addition to the memory device 204 described above, in one embodiment, the code and operation data for the operation of the gaming device described above may be stored in removable game cartridges or flash drives, a compact disk ROM, a digital versatile disk (DVD) optical storage technology, or suitable other fixed non-transitory storage mediums. In another embodiment, part or all of the code and operational data for operation of the gaming device or for execution of the game features may be stored in a remote memory structure and be downloaded to the memory device 204 via a network connection. In one embodiment, the gaming device 100 may utilize any combination of memory devices such as random access memory devices (RAMs), unalterable memory devices (ROMs), and mass storage devices for securely storing and securely communicating the software components or code that facilitate game play and other functions of the gaming device 100. The memory devices may store software components or code that include various game data and game related control and execution software. In some embodiments, the software components stored in the memory devices may include gaming system initialization software, system basic input and output software, operating system software, value acceptor software, value dispenser software, display image generation software, game symbol set image generation software, game rule execution software, game data set(s), random number generation software, system driver software, system data bus management software, audio generation and speaker driver software, and video generation and display driver software, and any other suitable software routines for operation of the gaming device 100.

In some embodiments, the memory devices, such as memory device 204, with the software components and other data may be secured and authenticated by authentication software stored in an unalterable memory device within the housing of gaming device 100. The gaming device 100 may also include application specific integrated circuits (ASICs) to perform the security and authentication functions. At any appropriate time, such as before each play of a game, at a predetermined interval, upon transfer of any game data or any software components from a mass storage to memory device 204, or upon demand, the gaming device 100 (using a processor such as processor 202 or a separate ASIC) may execute an authentication routine and perform an authentication of any software component or other data of the gaming device 100. In one embodiment, the gaming device software components may be prepared for authentication via creation and storage of an encrypted signature unique to one or more of the software components.

In one embodiment, an encrypted signature may be created by utilizing a hash function on a software component or code to form a message digest (i.e., a hash of the software component) followed by a key encryption of the message digest to form an encrypted signature unique to the software component. In some embodiments, the key encryption may be public key encryption, private key encryption, or any suitable key encryption schema. The encrypted signature may be stored with the gaming device software component, for example, in a mass storage device or an unalterable memory. During a software component authentication, the gaming device 100 executes one or more authentication routines utilizing the same hash function to operate on the software component to compute, or re-create, a new message digest for the software component. The new or re-created message digest may then be compared with a previously created message digest obtained by decrypting the stored encrypted signature. Matching message digests between the new and previously created message digests indicate that the software component is authentic and gaming device 100 may allow game play to proceed. However, when the message digests do not match, the gaming device 100 may determine that the software component under authentication may be corrupted or fraudulent and game play may be halted. It should be appreciated that the gaming device 100 may perform other suitable security and authentication checks on the game data or software components. Such authentication and security devices and functions are unique to gaming and casino industry to minimize or prevent fraud in gaming devices and gaming systems.

For a player to interact with gaming device 100, control unit 200 receives and processes player inputs, and control unit 200 causes processed results to be output or communicated to the player. In one embodiment, player inputs are recognized and processed or directed for processing by input/output (I/O) controller 206. Further, I/O controller 206 may process and direct player outputs for communication to the player. I/O controller 206 can function as the intermediary between the specially configured processor 202 and one or more input devices to control information and data flow therebetween. I/O controller 206 may also function as the intermediary between the specially configured processor 202 and one or more output devices to control information and data flow therebetween. I/O controller 206 is configured to understand the communication and operational details (such as hardware addresses) for each attached input device and output device. In this manner, specially configured processor 202 is freed from the operational details of the peripheral I/O devices. For example, in one embodiment where an input or output device is changed or upgraded, I/O controller 206 can be changed without changing other gaming system 100 components.

In one embodiment, a player deposits value into gaming device 100 by inserting some form of currency into a value acceptor 208 for game play. Alternatively, a player deposits value into gaming device 100 by inserting an encoded paper ticket into a value acceptor 208 for game play in one embodiment. Value acceptor 208 can be combined with a currency reader and validator, and a code reader for reading value encoded on paper tickets. Value acceptor 208 may read, validate and communicate the amount of the inserted value to the specially configured processor 202. Specially configured processor 202 can establish a gaming credit balance for the player based on the communication from the value acceptor 208. Specially configured processor 202 can also communicate the player's credit balance on a credit balance display of gaming device 100. During game play, each time a player risks a wager on an outcome, specially configured processor 202 processes the wage and determines the amount of credits to debit from the player's credit balance. When a winning outcome is obtained, specially configured processor 202 is configured to determine the amount of credits to add to the player's credit balance.

As previously mentioned with respect to FIG. 1, a variety of value acceptance arrangements are possible. In one embodiment, the value acceptor 208 could include magnetic strip or chip card readers to accept and transfer value. Value acceptor 208 may also be configured to accept and transfer non-traditional currencies such as digital currencies. In these embodiments, I/O controller 206, a specially configured processor 202, or both contain appropriate control instructions to communicate and extract value from the inserted item containing value. In one embodiment, use of a magnetic strip or embedded chip card, for example a bank card, for value insertion requires specially configured processor 202 to communicate, via network interface controller 224 (described below), with devices external to the gaming device 100.

In one embodiment, card reader 210 may be included in gaming device 100 to accept player loyalty cards. For example, card reader 210 can extract account identifying information from the card and utilizes this information to access the associated account information stored remotely via network interface controller 224. In embodiments where player loyalty/player tracking systems are employed, a player's loyalty account and record of gaming activity can be stored in a networked storage location or database. Specially configured processor 202 is configured to record the player's gaming activity in memory device 204 during the duration of loyalty card insertion. When the loyalty card is removed from card reader 210, recorded gaming activity is uploaded, via network interface controller 224, to the remote storage location associated with the player's account. In this manner, the player's gaming activity can be further processed and analyzed, and the player can be awarded loyalty rewards based upon his activity data.

In various embodiments, player control 212 receives a player's game inputs and communicates the player's game inputs to specially configured processor 202. The player's game inputs may include, but are not limited to, wager amounts, pay line selections, game control signals, and cash-out signals. The player control 212 may generate signals based on button presses, touch screen activations, or voice control. The player initiated signals are propagated to the specially configured processor 202 by I/O controller 206. Further, the player initiated signals may direct and inform execution of the game instructions stored in memory device 204 and configured to be executed by specially configured processor 202.

In one embodiment, specially configured processor 202 is configured to execute stored program code and instructions which generate random numbers or pseudo-random numbers. In one embodiment, as illustrated in FIG. 2, a random number generator (RNG) 214 is a software module configured to be executed by specially configured processor 202 for the generation of a true random or pseudo-random number. The code for RNG 214 may be stored in memory device 204. RNG 214 generates random numbers for use by the gaming software during game execution. In one embodiment, random numbers are utilized by game software for the random selection of one or more game symbols from a set of game symbols during a game. As a non-limiting example, the set of game symbols can include numbers, letters, geometric figures, symbols, images, character, animations, blank symbols (e.g., the absence of symbols), or any other suitable graphical depiction. In various embodiments, once random symbols are selected based upon the random number generated by RNG 214, patterns of symbols are compared to determine wagering outcomes. In an alternative embodiment, gaming device 100 may include a hardware based random number generator that is in communication with specially configured processor 202 to supply random numbers for game generation purposes. The hardware based random number generator may be incorporated into specially configured processor 202 or can be separate from specially configured processor 202.

In yet another embodiment, random generation of "numbers" or symbols may be performed with electro-mechanical components. For example, gaming devices such as gaming device 100 may incorporate a plurality of mechanical reels rotatable about a common axis. A plurality of indicia or symbols may be positioned around the periphery of the plurality of reels. Each of the indicia or symbols on each reel may indicate separate detectable reel stop positions. The reels can be set into a spinning/rotation motion by pulling a lever or pushing a button. In some embodiments, the gaming device 100 can stop the reels by the gaming device 100 actuating, on a random timing basis, a suitable mechanical or electro-mechanical reel brake. When the reels stop rotating, one or more displayed stop positions of each reel is detected. Since the stop positions are each associated with an indicia or symbol, the gaming device can determine whether the combination of stop positions (i.e., translating to a combination of displayed symbols) results in a winning symbol combination.

Returning to FIG. 2, control unit 200 controls the function and output of a plurality of output devices utilized by gaming device 100. In various embodiments, I/O controller 206 serves as an interface unit between specially configured processor 202 and output devices such as video processor 216, cabinet lighting controller 218, audio controller 220, and value dispenser 222.

In one embodiment, video processor 216 communicates with specially configured processor 202 to render all game graphics, video displays, and information on gaming device 100's one or more video display units. In one embodiment, video processor 216 includes one or more processors, controllers, and/or graphics cards for processing the game images, outcomes, and animated displays and coordinating the processed data to be display between, among, or across any or all display devices. In various embodiments, this may include being configured to simulate objects and the movement of objects which represent video reels containing sets of gaming symbols.

It should be appreciated that in certain other embodiments where physical mechanical reels are utilized by the gaming device 100 as a game displays, reel controllers and stepper motors would be provided in lieu of or in addition to video processor 216.

In embodiments which utilize cabinet lighting as described with respect to FIG. 1, a cabinet lighting controller 218 may be utilized to coordinate and control the color and timing of cabinet lighting displays with specially configured processor 202. In certain embodiments which utilize sound design, specially configured processor 202 may utilize audio controller 220 to coordinate and control the sound emissions. In one embodiment, audio controller 220 may include one or more audio processing cards for generating sound and for driving the one, two or more speakers that may be included with gaming device 100.

In various embodiments, players may collect remaining credit value by initiating a signal via player control 212 which is communicated to specially configured processor 202 via I/O controller 206. The signal triggers a readout of the player's credit amount and specially configured processor 202 initiates a value dispensing signal which, in turn, is communicated to value dispenser 222. In one embodiment, value dispenser 222 can be controlled to issue the player's credit value using any of the types of value discussed herein. In some embodiments, the player's credit value may be issued to the player via a printed and dispensed encoded paper ticket or token which the player can then exchange at a special purpose kiosk or cashier location for the monetary value encoded into the ticket or token. In some embodiments, the specially configured processor 202 can direct the value dispenser 222 to issue to the player an appropriate amount of coin or bills directly to the player. Additionally, or alternatively, in some embodiments, the player may have the option to electronically direct the credit value to an account associated with the player.

In some embodiments, control unit 200 of gaming device 100 may communicate with one or more devices outside the gaming device 100. For example, gaming device 100 may be connected to a larger gaming network via a local area network (LAN) or a wide area network (WAN). Control unit 200 may communicate with one or more central servers, controllers, or remote devices to execute games, establish credit balances, participate in jackpots, etc. In such embodiments, network communications and connections are accomplished via a network interface controller 224. Network interface controller 224 can be a digital circuit board or card installed in control unit 200 to provide network communications with external devices.

In some embodiments, various additional features and functions are performed by control unit 200. For example, control unit 200 may be specially configured with appropriate software to track all game play events that occur on gaming device 100. In some embodiments, control unit 200 may audit all recorded monetary transactions, including all wager amounts, game outcomes, game winnings, and game payouts that occur through gaming device 100. Further, some embodiments may include security software to assist in protecting the gaming device 100 from tamper or alteration attempts.

Game Including Efficient Game Evaluations

Figure 3A:
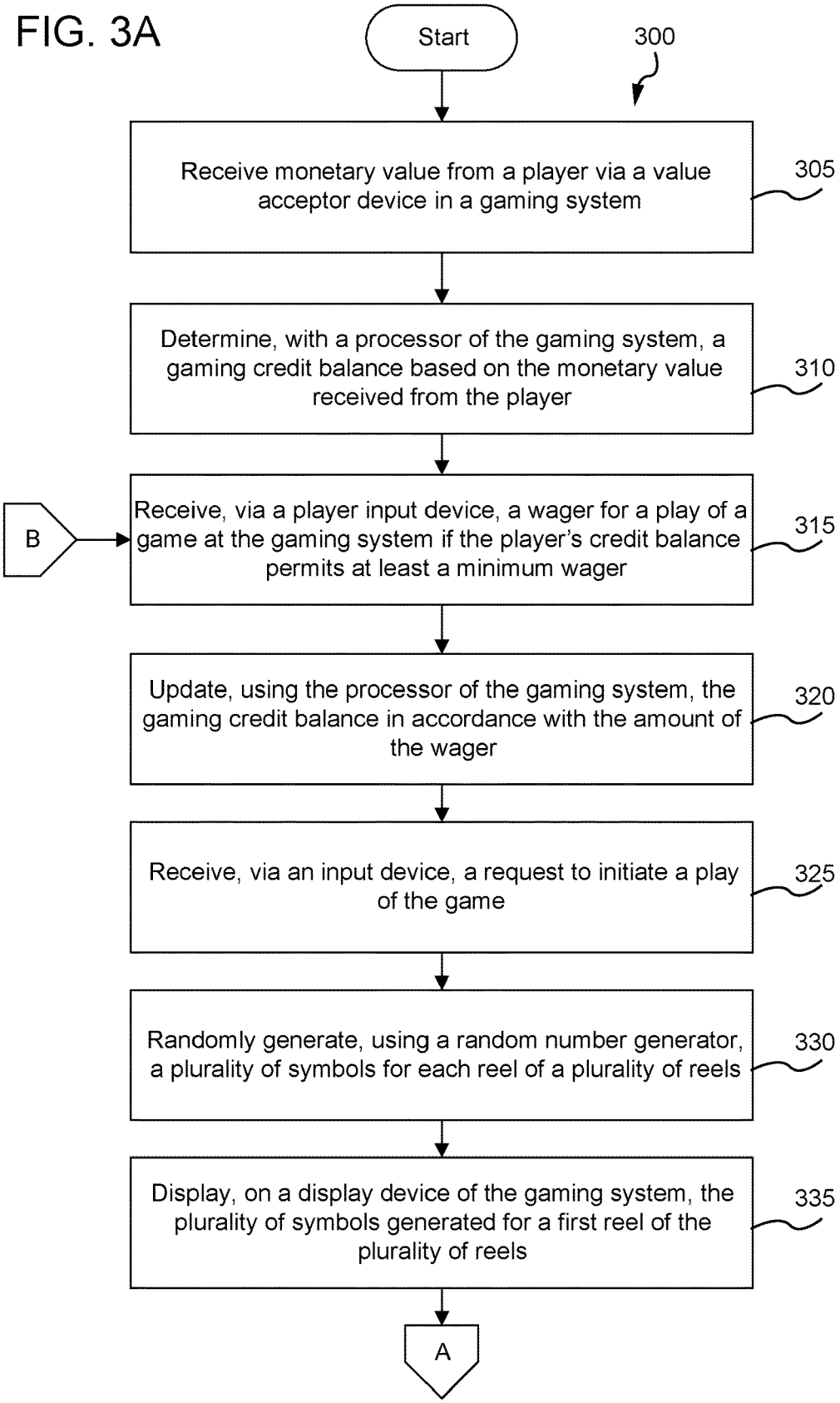
FIGS. 3A, 3B, and 3C illustrate one embodiment of a method of operating the gaming system.
Figure 3B:
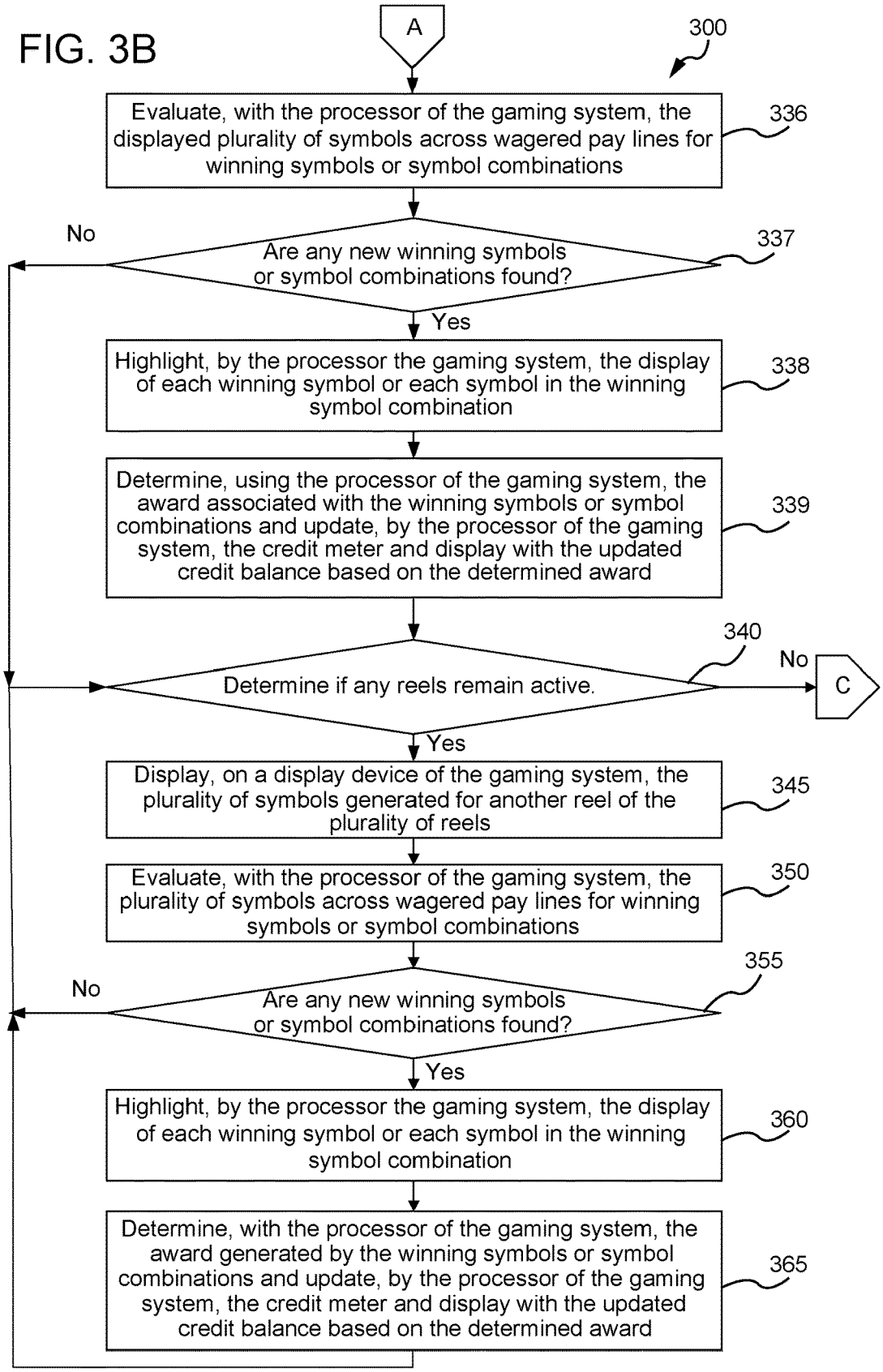
Figure 3C:
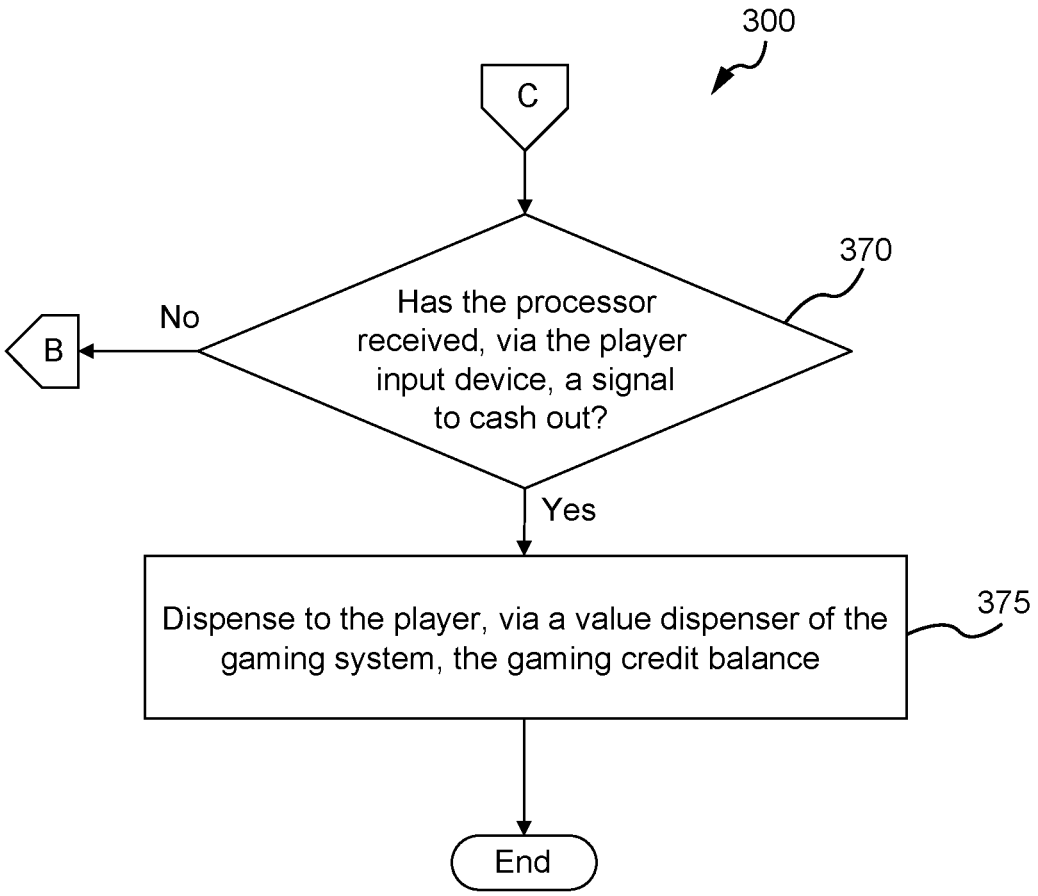

FIGS. 3A, 3B, 3C illustrate a flowchart of an example operation 300 of one embodiment of the gaming system and method. In one embodiment, a processor is configured, via instructions stored in a memory device, to perform the operation 300. However, it should be appreciated that other suitable variations of operation 300 are possible. For example, in one embodiment, fewer or one or more additional blocks (not shown) may be employed in operation 300 of the gaming system and method. In other embodiments, the blocks may be performed in any suitable order.

FIG. 3A illustrates one embodiment in which the gaming system receives a monetary value from a player to initiate operation 300. As indicated in block 305, the gaming system may receive monetary value via a value acceptor device associated with the gaming system. The value acceptor device, in one embodiment, is disposed in a gaming system or in communication with the gaming system as discussed above.

In one embodiment, the gaming system determines a credit balance based on the monetary value received from the player at a value acceptor device as indicated in block 310. The gaming system determines, via a processor, a gaming credit balance for the player. The gaming credit balance may be based on the monetary value received from the player at the value acceptor device.

In one embodiment, the gaming system may receive a wager for a play of a game at the gaming system. Block 315 of FIG. 3A illustrates one embodiment where the player's wager is received via a player input device. The gaming system may allow a player to place a minimum wager, a maximum wager, or any suitable wager amount. Depending on the wager amount, the gaming system may also enable the player to select pay lines across displayed symbol positions on reels in a game in which to place wagers. In one embodiment, the gaming system may determine whether the player provided enough credits to enable the player's selected wager. The gaming system may prevent the player from placing the wager and starting a play of a game if the player's credit balance is not large enough to support the player's selected wager. If enough credits are not available in the player's credit balance, the gaming system enables the player to insert additional value to obtain the minimum credit level or to cash out of the gaming system.

In one embodiment, the gaming system may use a processor of the gaming system to update a gaming credit balance. The credit balance may be updated in accordance with the player's wager amount as indicated in block 320. In some embodiments, the credit balance is not updated until a later time.

Block 325 illustrates one embodiment in which the gaming system may receive a request to initiate a play of a game. The request to initiate the play of the game may be received from a player via a player input device in communication with the gaming system. The gaming system may securely access game data from a memory device and execute an authentication routine on the game data to start a play of a game. For example, the player may press a spin button on the gaming system to start spinning slot machine reels of the gaming system (or randomly generating symbols using other methods discussed above for video reels or virtual reels) for the play of the game. It should be appreciated that reels used throughout the specification may refer to mechanical reels, electro-mechanical reels, or virtual video reels (where virtual reels strips or no reel strips are used). It should further be appreciated that although many examples illustrated in the specification describe the games in terms of slot machines with reels, other games may be used, including games without slot machine reels.

In one embodiment, the gaming system may use a random number generator to randomly generate a plurality of symbols for the play of the game as indicated in block 330. In some embodiments, the gaming system generates the plurality of symbols for display on a plurality of reels as indicated in block 330. In some embodiments, the gaming system may use the random number generator to randomly generate the plurality of symbols for at least one reel of the plurality of reels. In some embodiments, the gaming system may generate symbols for additional reels as the play of the game progresses. In some embodiments, the gaming system generates a plurality of sets of symbols that are each associated with one of the display reels. As used herein, the random number generation may refer to pseudo-random or true-random number generation depending on the module used for the random number generation. As used herein, the reels maybe mechanical, electromechanical, virtual video reels, or some combination of the foregoing.

In one embodiment, the gaming system may cause a display device to display a portion of the generated plurality of symbols for a first reel of the plurality of reels as indicated in block 335. The gaming system may stop the first reel from spinning and display the portion of the generated plurality of symbols on the first reel. The gaming system may display the generated plurality of symbols in visible symbol display areas of the first reel. In alternative embodiments, the gaming system may cause a display device to display some of the generated plurality of symbols for two or more reels of the plurality of reels (e.g., less than all of the reels). Off page connector A refers to FIG. 3B to continue operation 300. In one embodiment, the gaming system keeps the other remaining reels active or spinning.

Turning now to FIG. 3B and off page connector A, in one embodiment, as shown in block 336, the gaming system evaluates, with the processor of the gaming system, the displayed plurality of symbols on the first reel along wagered pay lines for winning symbols or symbol combinations.

If the gaming system determined that winning symbols or symbol combinations were generated for the first reel as shown in block 337, the gaming system highlights each symbol that is a winning symbol or part of a winning symbol combination as shown in block 338. For example, the gaming system can flash a border around such symbols to highlight the winning symbols. The gaming system may change the background or background color behind such symbols. The gaming system may flash the background image or color behind such symbols. It should be appreciated that the gaming system may highlight such symbols in any suitable manner. On the other hand, if the gaming system determines that no winning symbols or symbol combinations were generated, then the gaming system moves to block 340 and skips highlighting winning symbols and determining awards.

In block 339, the gaming system determines, using the processor, the award associated with the winning symbols or symbol combinations. In some embodiments, the gaming system displays the award to the player in a conspicuous manner, such as by displaying the award over the game display. The gaming system may display the award to the player in any other suitable manner. The gaming system may also update, by the processor, the credit meter and display with the updated credit balance based on the determined award as shown in block 339. In some embodiments, the gaming system may highlight the credit meter to draw attention to the award amount in the credit meter. It should be appreciated, that in some embodiments, the award may not be a monetary value. In such embodiments, the credit meter is not updated with an award value.

In one embodiment, where the gaming system uses a pay table to evaluate the generated symbols and the pay table does not provide any wins based on a single symbol, blocks 336, 337, 338, 339 may not be used in operation 300. That is, if the gaming system never provides any awards based on a single symbol in one reel, operation 300 may not include blocks 336, 337, 338, and 339 because the gaming system would not need to evaluate symbols generated on a single reel without generated symbols on additional reels. Similarly, where the gaming system does not pay awards based on symbols generated on less than three reels, the gaming system may not use block 336, 337, 338, and 339 and may not start block 340 until the gaming system has generated and displayed symbols on at least three reels.

Returning now to FIG. 3B, in one embodiment as shown in block 340, the gaming system evaluates whether additional reels remain active (e.g., whether additional reels remain spinning). If no reels remain active, operation 300 proceeds to off page connector C, which is discussed in further details below.

On the other hand, if the gaming system determines that additional reels remain active at block 340, operation 300 continues to block 345. In block 345, the gaming system may cause the display device to display a portion of the generated plurality of symbols for another reel (in this case, a second reel) of the plurality of reels as indicated in block 345. The gaming system may stop the second reel from spinning and display the portion of the generated plurality of symbols associated with the second reel. The gaming system may display the generated plurality of symbols in visible symbol display areas of the second reel.

As shown in block 350, the gaming system evaluates, with the processor, the displayed plurality of symbols on the first reel and second reel along wagered pay lines for winning symbols or symbol combinations.

If the gaming system determined that winning symbols or symbol combinations were generated for the first reel as shown in block 355, the gaming system highlights each symbol that is a winning symbol or part of a winning symbol combination as shown in block 360. For example, the gaming system can flash a border around such symbols to highlight the winning symbols. It should be appreciated that the gaming system may highlight such symbols in any suitable manner. On the other hand, if the gaming system determines that no winning symbols or symbol combinations were generated, then the gaming system returns to block 340 and skips highlighting winning symbols and determining new awards.

When winning symbols or symbols combinations are determined, the gaming system determines, using the processor, the award associated with the winning symbols or symbol combinations at block 365. The gaming system may determine the award by comparing the winning symbols or symbol combinations to the pay table associated with the game. In some embodiments, the gaming system displays the award to the player in a conspicuous manner, such as by displaying the award over the game display. The gaming system may display the award to the player in any other suitable manner. The gaming system may also update, by the processor, the credit meter and display with the updated credit balance based on the determined award as shown in block 365. In some embodiments, the gaming system may highlight the credit meter to draw attention to the award amount in the credit meter. It should be appreciated, that in some embodiments, the award may not be a monetary value. In such embodiments, the credit meter is not updated with an award value.

The operation 300 of the gaming system may return to block 340 and continue to loop through blocks 340-365 until no reels remain active. In an embodiment where the gaming system uses five reels, the gaming system may loop through block 340-365 four times. It should therefore be appreciated that in some embodiments, the gaming system incrementally displays and evaluates one additional active reel each time operation 300 loops through blocks 340-365. It should also be appreciated that in some embodiments, the gaming system may evaluate more than one additional reel each time operation 300 loops through blocks 340-365.

In a gaming system and method with incremental evaluation of symbol sets (e.g., displayed or displayable symbols on a reel) for winning symbol combinations, the resulting gaming system becomes more efficient. For example, a processor or processors of the gaming system process smaller quantities of data (e.g., evaluating smaller symbol sets on reels as the symbols are revealed) rather than processing all of the reels at once. The gaming system avoids loading the entire set of generated symbols into memory at one time to perform a win evaluation, which reduces the amount of system memory that gaming system uses for a play of the game.

The incremental game evaluation also provides for shorter game evaluation processing at the end of a play of the game because the bulk of the game evaluation processing was already performed. The resulting play of the game ends sooner and the next play of the game can begin faster. Thus, the time between games is reduced and the overall rate of play on the gaming system can be increased. The more games that a gaming system can process in a day, the more cost effective the gaming system becomes for a gaming system operator.

Moreover, a gaming system and method with incremental game evaluation processing also builds a new sense of anticipation for a player as win amounts and quantities of winning symbols are accumulated over time, rather than displayed all at once. As a player obtains winning symbols with awards while reels remain active, the gaming system provides the player a greater sense of anticipation that each reel that remains active may produce a larger win and add to the player's existing winnings.

In some embodiments, for each loop through blocks 340-365, each new win amount obtained (e.g., when a reel is stopped) replaces the prior win amount such that the player retains only the latest new win amount. In alternative embodiments, each new win amount is additive with the prior win amount and the gaming system provides each win amount to the player, resulting in larger win amounts.

In one embodiment, returning now to block 340, if the gaming system determines that no reels remain active, the operation 300 moves to block 370 in FIG. 3C via off page connector C.

In one embodiment, as indicated in block 370, the gaming system may receive a signal to end game play or "cash out" via an input device of the gaming system. In such a situation, the gaming system dispenses a value to the player, through a value dispenser, based on the player's gaming credit balance as illustrated in block 375 and operation 300 ends.

On the other hand, if the gaming system processor has not received a signal to end game play via the player input device, the process of operation 300 returns to block 315 in FIG. 3A via off page connector B. The gaming system may receive, via a player input device, a wager for another play of the game and continue operation 300 from block 315. However, in one embodiment, the wager may not be accepted if the player has fewer credits than the player's selected wager amount, as shown in block 315.

In one embodiment at block 340, the gaming system further evaluates whether any wins are possible before proceeding to block 345 verses block 370 (not shown). In one such embodiment, the gaming system evaluates the displayed symbols on the reels from left to right. If no symbols generated and displayed on the evaluated reel correlate to any wins on an associated pay table and no wins are possible when the next reel is stopped, the gaming system may not perform any additional symbol evaluations for winning symbol combinations for the play of the game (even if reels remain active). In some such embodiments, the gaming system stops all of the remaining reels from spinning and displays all of the generated symbols on the associated reels and provides an indication to the player that the game is over. In alternative embodiments, the gaming system stops all of the remaining reels and exits the play of the game before displaying any additional symbols. In still other embodiments, the gaming system may enable the player to exit a play of the game early (before displaying generated symbols on all of the reels). Thus, the gaming system may prevent further system resources from being used for game evaluations when the remaining active reels will not result in a winning outcome for the player. That is, fewer processor cycles and memory are used for a play of the game results in gaming systems that lower power usage and lower heat generation by the gaming system. Lower power usage and lower heat generation result in gaming systems that are more efficient and less costly to operate. When the reduced processor and memory usage is applied over many games and many gaming systems, the efficiencies and cost saving dramatically increase. Moreover, the faster a gaming system can set a player up to start a new play of the game, the gaming system can increase the revenue for the gaming system, which also results in a more cost efficient gaming system for a gaming system operator.

It should be appreciated that the efficient game evaluations can be applied in both base games and bonus games.

Figure 4A:
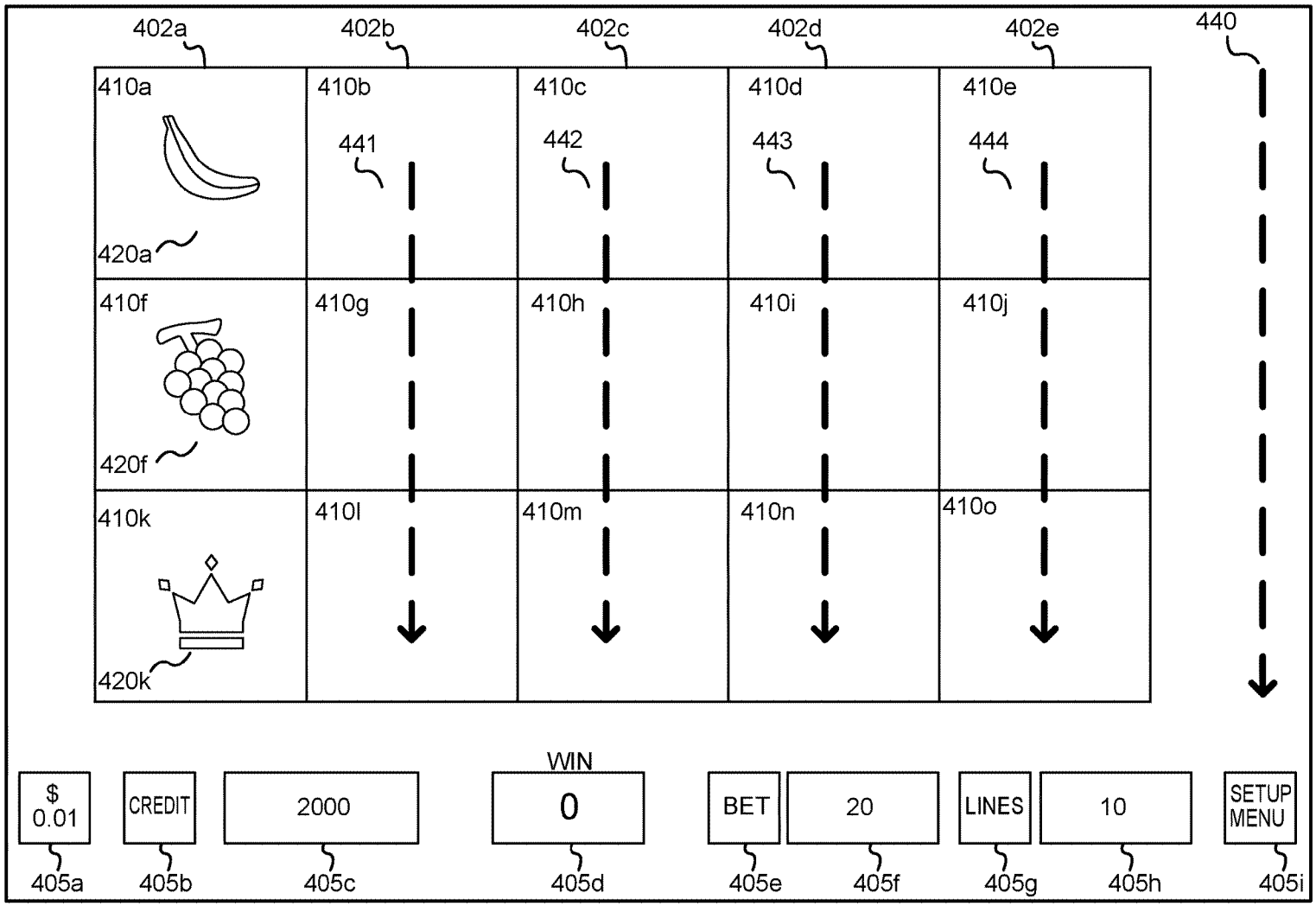

FIGS. 4A-4F, illustrate screen shots of one embodiment of a gaming system having efficient game evaluations. FIG. 4A illustrates one embodiment of a game display 400 that the gaming device 100 may display on a display device. In one embodiment, game display 400 may be displayed on the first display 122 of gaming device 100 illustrated in FIG. 1. However, any other suitable display may be used. The game display 400 displays a set of a plurality of virtual video slot machine reels 402*a*, 402*b*, 402*c*, 402*d*, and 402*e* as illustrated in FIG. 4A for a base game or a bonus game. As also illustrated in FIG. 4A, the reels 402*a*-402*e* are displayed substantially side by side. It should be appreciated that reels 402*a*-402*e* can be displayed with any suitable amount of separation or no separation. It should be appreciated that the game shown in game display 400 is merely representative and may have more or fewer game elements shown in the game display 400.

The plurality of reels 402*a*-402*e* are each associated with a set of symbols, where the set of symbols includes a plurality of symbols. Each reel 402*a*-402*e* is associated with a plurality of symbols of the set of symbols. Each reel 402*a*-402*e* can also be associated with the same or a different plurality of symbol combinations from the first set of symbols. The sets of symbols may include numbers, letters, geometric figures, symbols, images, character, blank symbols (e.g., the absence of symbols), animations, or any other suitable graphical depiction. The symbols in the sets of symbols may include pay symbols and special or designated symbols.

Returning now to FIG. 4A, the game display 400 depicts a plurality of symbol display areas 410*a*, 410*b*, 410*c*, 410*d*, 410*e*, 410*f*, 410*g*, 410*h*, 410*i*, 410*j*, 410*k*, 4101, 410*m*, 410*n*, and 410*o*. These plurality of symbol display areas can be associated in a manner that provides the appearance of game reels. It should also be appreciated that the symbol display areas may not be associated with game reels in some embodiments. As illustrated in FIG. 4A, symbol display areas 410*a*, 410*b*, 410*c*, 410*d*, 410*e*, 410*f*, 410*g*, 410*h*, 410*i*, 410*j*, 410*k*, 4101, 410*m*, 410*n*, 410*o* are associated in a manner that provides the appearance of a set of five game reels. In one embodiment, the plurality of symbol display areas that provide the appearance of five game reels may be arranged in a manner that visibly shows three symbol positions of each of the five game reels. For example, the symbol display areas 410*a*-4010 are each associated with positions on reels 402*a*-402*e*, respectively. As shown in FIG. 4A, symbol display areas 410*a*, 410*f*, and 410*k* are associated with reel 402*a*; symbol display areas 410*b*, 410*g*, and 410*l* are associated with reel 402*b*; symbol display areas 410*c*, 410*h*, and 410*m* are associated with reel 402*c*; and symbol display areas 410*d*, 410*i*, and 410*n* are associated with reel 402*d*; and symbol display areas 410*e*, 410*j*, and 410*o* are associated with reel 402*e*. The arrangement illustrated in the embodiment of FIG. 4A thus creates a visible display area of the reels 402*a*-402*e* comprising three visible symbol display positions for each reel. When viewed together, reels 402*a*-402*e* appear like a 3-row by 5-column reel array in game display 400. In other embodiments, smaller or larger visible areas of the reels can be displayed. That is, the reels 402*a*-402*e* may show fewer or a larger number of visible symbol display areas. While symbol display areas are illustrated with defined boxes, it should be appreciated that in some embodiments, the defined boxes are not visible to the player.

Each reel 402*a*-402*e* may display a plurality of symbols that the gaming system generates from the set of symbols in their respective symbol display areas as illustrated in FIG. 4A. Spin directions 440, 441, 442, 443, and 444 illustrate the direction that the reels may be shown spinning in one embodiment. However, it should be appreciated that the reels may be shown spinning in any suitable direction. The reels may also be shown spinning in different directions in some embodiments.

Game display 400 also includes several information areas and buttons 405*a*-405*i*. These information areas and buttons 405*a*-405*i* are illustrated in a particular arrangement, but may be arranged in any suitable manner in different embodiments. In some embodiments, game display 400 may include more or fewer display areas and buttons 405*a*-405*i* than illustrated in FIG. 4A-4H. Information area 405*a* illustrates an example value of one credit for the game displayed in game display 400. Information areas 405*b* and 405*c* illustrate an example of the amount of the player's available credits. Information area 405*d* illustrates the amount of credits a player has won. Because FIG. 4A illustrates the start of a play of a game, the information area 405*d* shows zero credits have been won. Button 405*e* illustrates a software button that the player can select to place a bet or wager. It should be appreciated that the functionality of button 405*e* may also be replicated or replaced with a hardware button on the gaming device 100. Information area 405*f* illustrates that the player has selected to wager 20 credits. Button 405*g* illustrates a software button that the player can select to determine how many pay lines to wager on. It should be appreciated that the functionality of button 405*g* may also be replicated or replaced with a hardware button on the gaming device 100. Information area 405*h* illustrates that the player selected to wager on 10 pay lines. Button 405*i* illustrates a software button that the player can select to obtain information about the game, change certain aspects of the game, obtain help, place an order, etc.

To start a gaming session, a player provides the gaming system with a deposit of value, using one of the suitable mechanisms discussed above. The gaming system receives and validates the player's deposit of value. The gaming system can then issue credits (or gaming credits) to the player based on the received value. The credits enable the player to initiate a play of a game and to also place wagers on a play of the game. The gaming system may provide a visual indication of the player's credit balance to the player as discussed above in information area 405*c*.

To initiate a play of a game, the player activates or presses one or more appropriate buttons on the gaming system to deduct credits necessary to play the game and to identify the player's wager. Along with receiving the player's wager, the gaming system may receive pay line selections or other game functions the player wishes to activate in exchange for the wager. The player may also actuate a game start button or a spin button. The gaming system may deduct the appropriate credits from the player's credit balance after the wager or at any suitable time.

Upon receipt of the player's wager and activation of the game start button, the gaming system may show a display of spinning reels for each of the reels 402*a*-402*e*. The spinning may appear to occur in a vertical top to bottom direction as illustrated with spin direction 440, 441, 442, 443, and 444 in FIG. 4A or in a vertical bottom to top direction (not shown), or in a combination of vertical directions (not shown).

Figure 4B:
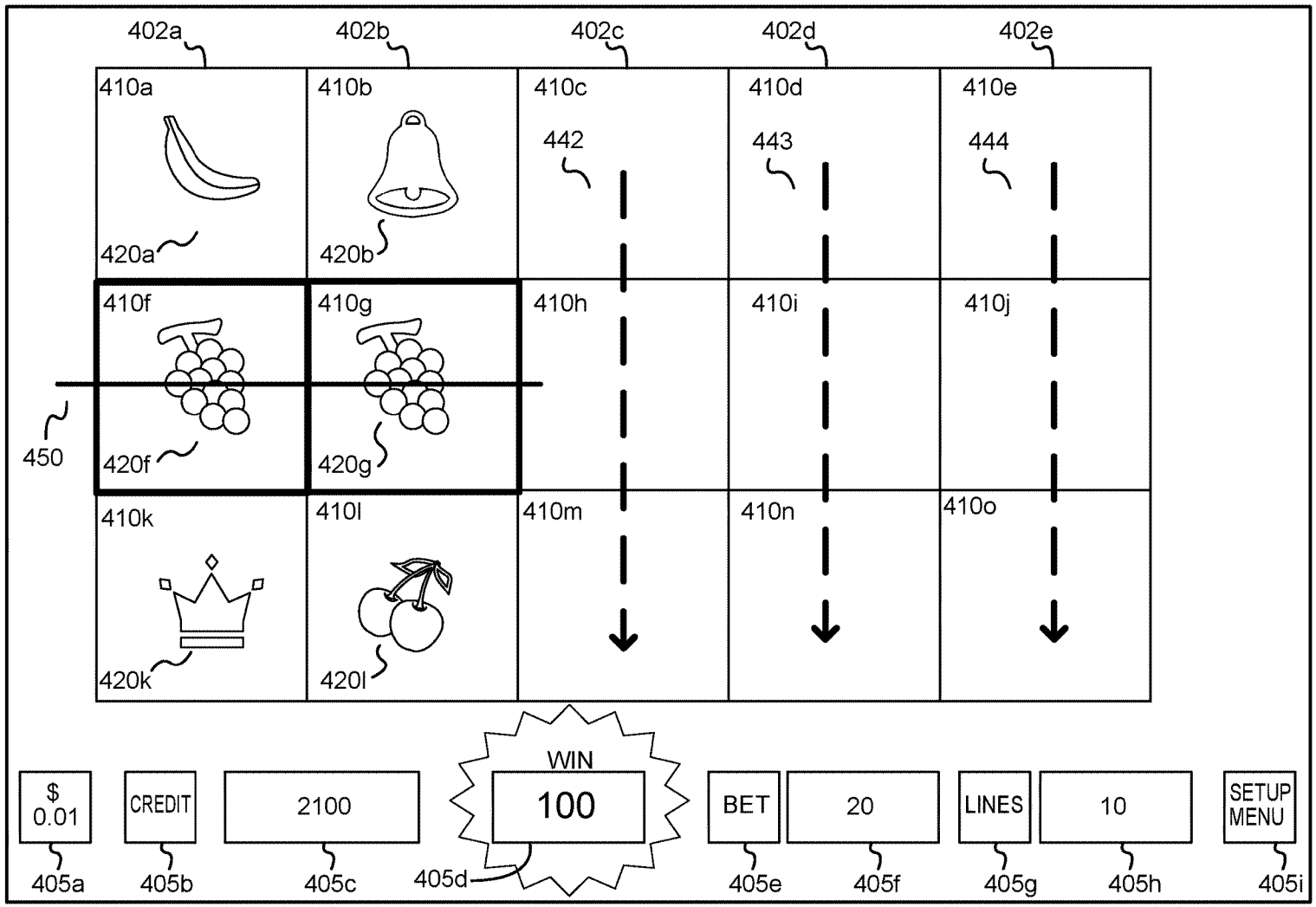

In one embodiment, the gaming system randomly generates symbols from the associated sets of symbols for reels 402*a*-402*e*, respectively. As shown in FIG. 4A, the gaming system generated and displayed symbols 420*a*, 420*f*, and 420*k* in symbol display areas 410*a*, 410*f*, and 410*k* for reel 402*a*. In alternative embodiments, the gaming system randomly and incrementally generates symbols from the associated sets of symbols for reels 402*a*-402*e* as the game progresses (e.g., the gaming system does not generate all of the symbols from the associated sets of symbols for each reel at substantially the same time; rather the gaming system generates the symbols from the associated sets of symbols for each reel when required to display new symbols on reels). As noted above, the gaming system may rely on random generation performed by a pseudo RNG, a true RNG, or hardware RNG. In embodiment, the gaming system may also update the player's credit meter (information area 405*c*) to reflect the player available credit balance. As shown in FIG. 4B, the player's credit meter (information area 405*c*) was decremented by 200 credits from 2200 to 2000, reflecting the 200 credit wager the player placed for the play of the game.

The gaming system stops reel 402*a* from spinning and displays the generated symbols 420*a*, 420*f*, and 420*k* in symbol display areas 410*a*, 410*f*, and 410*k* for reel 402*a* as illustrated in FIG. 4A. The gaming system also keeps reels 402*b*-402*e* active and continues to show these reels spinning. As illustrated in FIG. 4A, the gaming system generated and displayed a Banana symbol (420*a*), Grape symbol (420*f*), and a Crown symbol (420*k*) in the game display 400. It should be appreciated that the displayed symbols are merely for explanatory purposes and the gaming system may randomly generate any suitable combination of symbols based on defined symbol sets.

Figure 5:
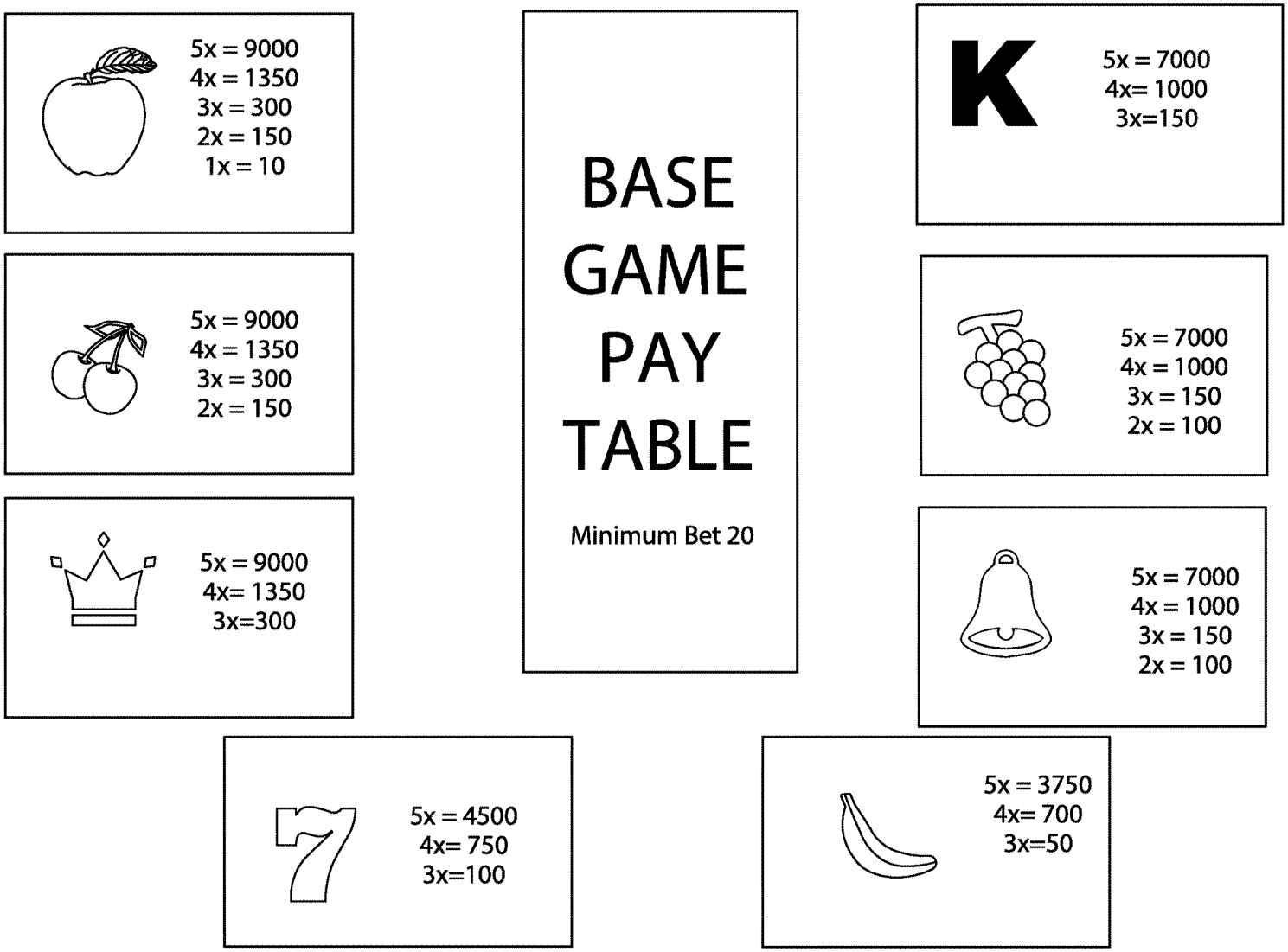
FIG. 5 illustrates one embodiment of a pay table for a gaming system.

In one embodiment, the gaming system evaluates the generated symbols on reel 402*a* for winning symbol combinations based on an associated pay table. One example pay table is illustrated in FIG. 5. In FIG. 5, the pay table indicated that a single Apple symbol may result in a winning symbol combination (e.g., 10 credits). As such, the gaming system evaluates the generated and displayed symbols on reel 402*a* for winning symbols. In FIG. 4A, the gaming system determines that no Apple symbols were generated. As such, the gaming system determines that no symbols should be highlighted and that no awards are to be provided. It should be appreciated that the pay table can be configured to provide different award variations with any suitable symbols. The award variations may include non-monetary or credit awards.

As illustrated in FIG. 4B, the gaming system determines that at least one reel is still active and gaming system stops an additional reel. In this embodiment, the gaming system stops reel 402*b* from spinning and displays the generated symbols 420*b*, 420*g*, and 420*l* in symbol display areas 410*b*, 410*g*, and 410*l* for reel 402*b*. The gaming system also keeps reels 402*c*-402*e* active and continues to show these reels spinning. As illustrated in FIG. 4B, the gaming system generated and displayed a Bell symbol (420*b*), Grape symbol (420*g*), and a Cherry symbol (420*g*) in the game display 400.

In one embodiment, the gaming system evaluates the generated symbols on reel 402*b* for winning symbol combinations based on the associated pay table in FIG. 5. In FIG. 5, the pay table indicates that a number of different symbols are associated with winning outcomes when two of such symbols are generated along a play line. For example, two Grape symbols along a pay line result in a winning symbol combination (e.g., 100 credits) according to FIG. 5. The gaming system evaluates the generated and displayed symbols on reel 402*b* for winning symbols. In one such embodiment, because the gaming system already evaluated the symbols on reel 402*a*, the gaming system does not need to reevaluate the symbols for reel 402*a*. The gaming system may have already stored which symbols were generated for reel 402*a* in memory. In order to further save memory and processing cycles, the gaming system may also restrict the evaluation of symbols on reel 402*b* to symbol display areas associated with symbols display areas from 402*a* that may produce a winning outcome. In the embodiment shown in FIG. 4B, each of the symbols displayed in reel 402*a* may result in a winning outcome. However, if one or more of the symbols displayed on reel 402*a* were not shown on the pay table in FIG. 5 (e.g., a Blank symbol or a Queen symbol was generated for reel 402*a*), the gaming system may skip evaluating the symbols along a pay line that coincided with such Blank symbol or Queen symbol because these symbols would not result in an award along associated pay lines (where a gaming system evaluates winning pay lines from the left reel to the right reel).

In FIG. 4B, the gaming system determined that two Grape symbols (420*f* and 420*g*) were generated along an pay line 450. According to the pay table in FIG. 5, two Grape symbols along an active pay line results in a 100 credit award. In one embodiment, if the gaming system determines that winning symbols were generated, the gaming system may highlight or otherwise call the player's attention to the winning symbols. As shown in FIG. 4B, the gaming system changed the borders around symbol display areas 410*f* and 410*g* to highlight the winning symbols to the player. In one embodiment, the gaming system further updates the player win meter 405*d* to reflect the player's winning based on the generated symbols for reels 402*a* and 402*b*. The gaming system may also highlight or otherwise call the player's attention to the award amount as shown by the flashing border around win meter 405*d*. However, the gaming system may not highlight the win meter 405*d* in some embodiments. In some embodiments, the gaming system may conspicuously display or flash the win amount to the player. For example, the gaming system may flash the win amount in the center of the game display 400 over the game screen image; provided however, the win amount may be displayed to the player in any other suitable manner. The gaming system may also update the player's credit meter 405*c* to reflect the win amount. As shown in FIG. 4B, the player's credit meter 405*c* was incremented to 2100 to reflect the 100 credit award for the two Grape symbols.

In some embodiments (not shown), the gaming system may end the game if the neither of the reels 402*a* and 402*b* produced any winning symbol combinations (e.g., where no winning symbol combination was possible for the remainder of the play of the game from symbols associated with the other reels). For example, in a game that evaluates displayed symbols on the reels from the left to right direction, if the two Grape symbols had not been generated, no winning symbols could be formed from the remaining active reels 402*c*, 402*d*, and 402*e*. Thus, the gaming system may stop the game to save processing cycles (e.g., eliminate unnecessary additional evaluations of the remaining reels and eliminate further generation of the symbols on reels 402*c*, 402*d*, and 402*e*). In alternative embodiments, the gaming system may enable the player to prematurely end the game when no wins are possible (and start a new play of the game sooner). For example, the gaming system may enable the player to press a hardware or software button to end the game prematurely, which also enables the gaming system to start a new play of the game. However, the gaming system may continue to display the generated symbols for remaining active reels even if no further wins are possible. Similarly, the above discussed early game exits may be applied later in the game where the gaming system determines that no additional winning outcomes are possible (even where reels remain active).

Figure 4C:
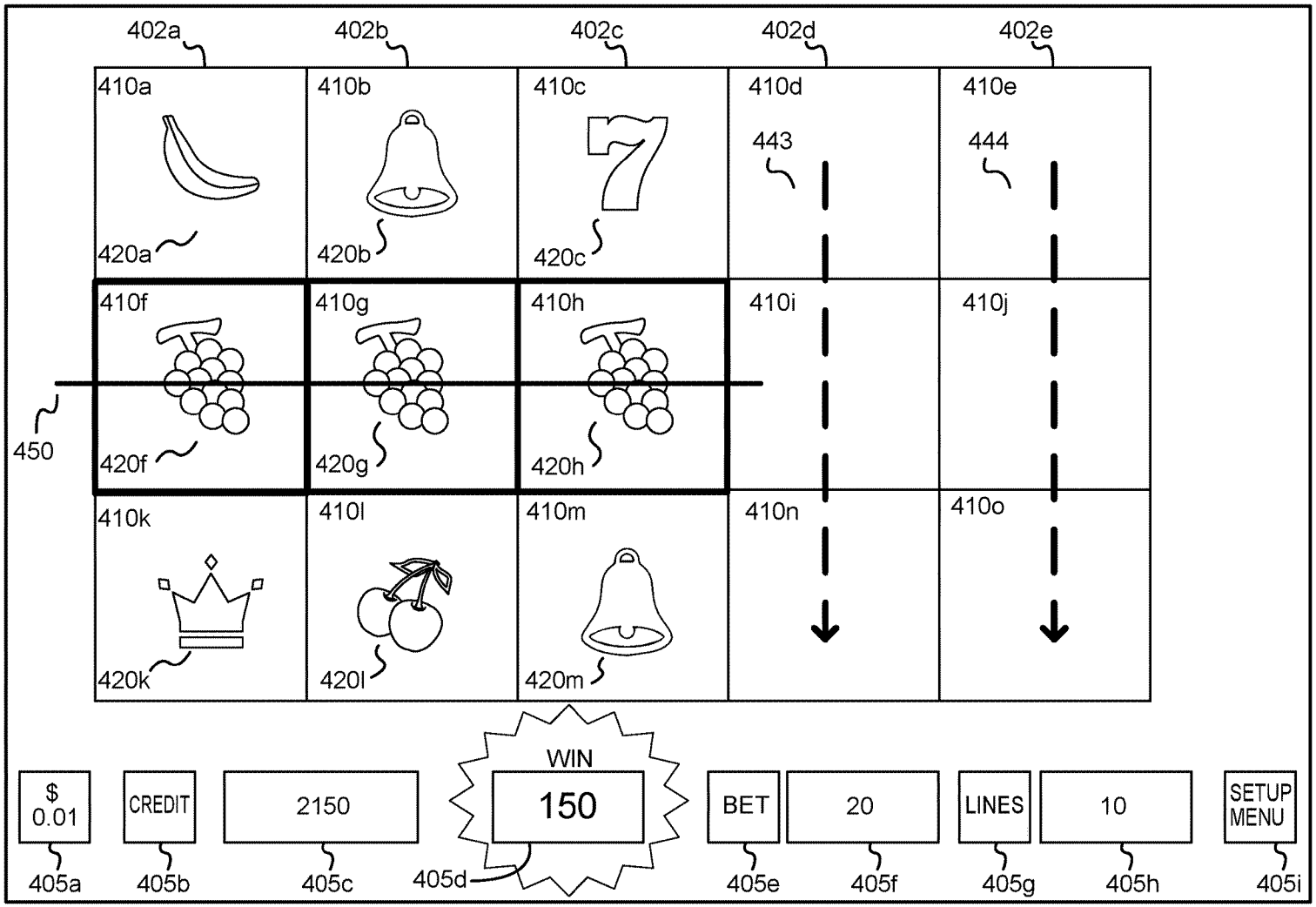

As illustrated in FIG. 4C, the gaming system determines that additional reels are still active and gaming system stops an additional reel. In this embodiment, the gaming system stops reel 402*c* from spinning and displays the generated symbols 420*c*, 420*h*, and 420*m* in symbol display areas 410*c*, 410*h*, and 410*m* for reel 402*c*. The gaming system also keeps reels 402*d* and 402*e* active and continues to show these reels spinning. As illustrated in FIG. 4C, the gaming system generated and displayed a Seven symbol (420*c*), Grape symbol (420*h*), and a Bell symbol (420*m*) in the game display 400.

In one embodiment, the gaming system evaluates the generated symbols on reel 402*c* for winning symbol combinations based on the associated pay table in FIG. 5. In FIG. 5, the pay table indicates that a number of different symbols are associated with winning outcomes when three of such symbols are generated along a play line. For example, three Grape symbols along a pay line results in a winning symbol combination (e.g., 150 credits) according to FIG. 5. The gaming system evaluates the generated and displayed symbols on reel 402*c* for winning symbols. In one such embodiment, because the gaming system already evaluated the symbols on reel 402*a* and reel 402*b*, the gaming system does not need to reevaluate the symbols for these reels. The gaming system may have already stored which symbols were generated for reel 402*a* and 402*b* in memory. In some embodiment, the gaming system only store winning symbols or representation of winning symbols in memory. In order to further save memory and processing cycles, the gaming system may also restrict the evaluation of symbols display areas that could possibly result in a winning outcome with symbols from reels 402*a* and 402*b*. In the embodiment shown in FIG. 4C, each of the symbols displayed along pay line 450 from reels 402*a* and reels 402*b* may result in a winning outcome, while the other symbols in reels 402*a* and 402*b* will not. Thus, the gaming system may restrict its evaluation of the symbols on reel 402*c* to the symbol 420*h* in symbol display area 410*h*. It should be appreciated that the gaming system may evaluate all of the display symbols on reel 402*c* and even on reels 402*a* and 402*b* in other embodiments.

In FIG. 4C, the gaming system determined that three Grape symbols (420*f*, 420*g*, and 420*h*) were generated along an active (e.g., wagered) pay line 450. According to the pay table in FIG. 5, three Grape symbols along an active pay line results in a 150 credit award. In one embodiment, if the gaming system determines that winning symbols were generated, the gaming system may highlight or otherwise call the player's attention to the winning symbols. As shown in FIG. 4C, the gaming system changed the borders around symbol display areas 410*f*, 410*g*, and 410*h* to highlight the winning symbols to the player. In one embodiment, the gaming system further updates the player win meter 405*d* to reflect the player's winning based on the generated symbols for reels 402*a*, 402*b*, and 402*c*. The gaming system may also highlight or otherwise call the player attention to the award amount by the flashing border around win meter 405*d*. However, the gaming system may not highlight the win meter 405*d* in some embodiments. In some embodiments, the gaming system may conspicuously display or flash the win amount to the player in other ways. For example, the gaming system may flash the win amount in the center of the game display 400 over the game screen image; provided however, the win amount may be displayed to the player in any other suitable manner. The gaming system may also update the player's credit meter 405*c* to reflect the win amount. As shown in FIG. 4C, the player's credit meter 405*c* was incremented to 2150 to reflect the 150 credit award for the three Grape symbols.

In some embodiments, as shown in FIG. 4A-4F, each new win amount that is obtained when the generated symbols are revealed for a particular reel replaces the prior win amount. However, in alternative embodiments, each new win amount may be additive with the prior win amounts. Using the illustrations from FIGS. 4B and 4C, the gaming system may award the player the 100 credit award for the two generated Grape symbols in FIG. 4B and the 150 credit award for the three generated Grape symbols in FIG. 4C. Thus, rather than providing the player the 150 credit award as shown in FIG. 4C, the gaming system may provide the player a much higher award total of 250 credits. Other mathematical operators may be applied to awards produced between each additional reel evaluation. In some embodiments different mathematical operators may be applied to awards produced between each additional reel evaluation.

It should now also be appreciated that incrementally evaluating and revealing symbols on reels while leaving other reels active increases the player's anticipation and excitement for what the next reel may reveal. This is an improvement over other reel based games where generated symbols and win evaluations occur so quickly that the player may not understand why the player won credits or lost.

In some embodiments, the gaming system may alter the timing of when the reels are stopped to further build the player anticipation for the next reel reveal (when the next reel is stopped). For example, the gaming system may stop the first reel from spinning after 1 millisecond, stop the $2^{nd}$ reel from spinning after 5 milliseconds, stop the $3^{rd}$ reel from spinning after 10 milliseconds, stop the $4^{th}$ reel from spinning after 20 milliseconds, and stop the $5^{th}$ reel from spinning after 1.5 seconds. It should be appreciated that any suitable time may be used for determining how long each reel spins or how long to delay stopping each additional reel after the prior reel is stopped. In one embodiment, as the player obtains larger awards as additional reels are stopped, the gaming system may increase the delay between stopping the next reel. For example, if the gaming system stopped four reels providing at least one winning symbol combination of four winning symbols, the gaming system may spin the $5^{th}$ reel for a much longer time (e.g., 2 seconds or otherwise creating a longer delay than between when the prior reels were stopped) before stopping the $5^{th}$ reel to reveal and evaluate the generated symbols on the $5^{th}$ reel.

Figure 4D:
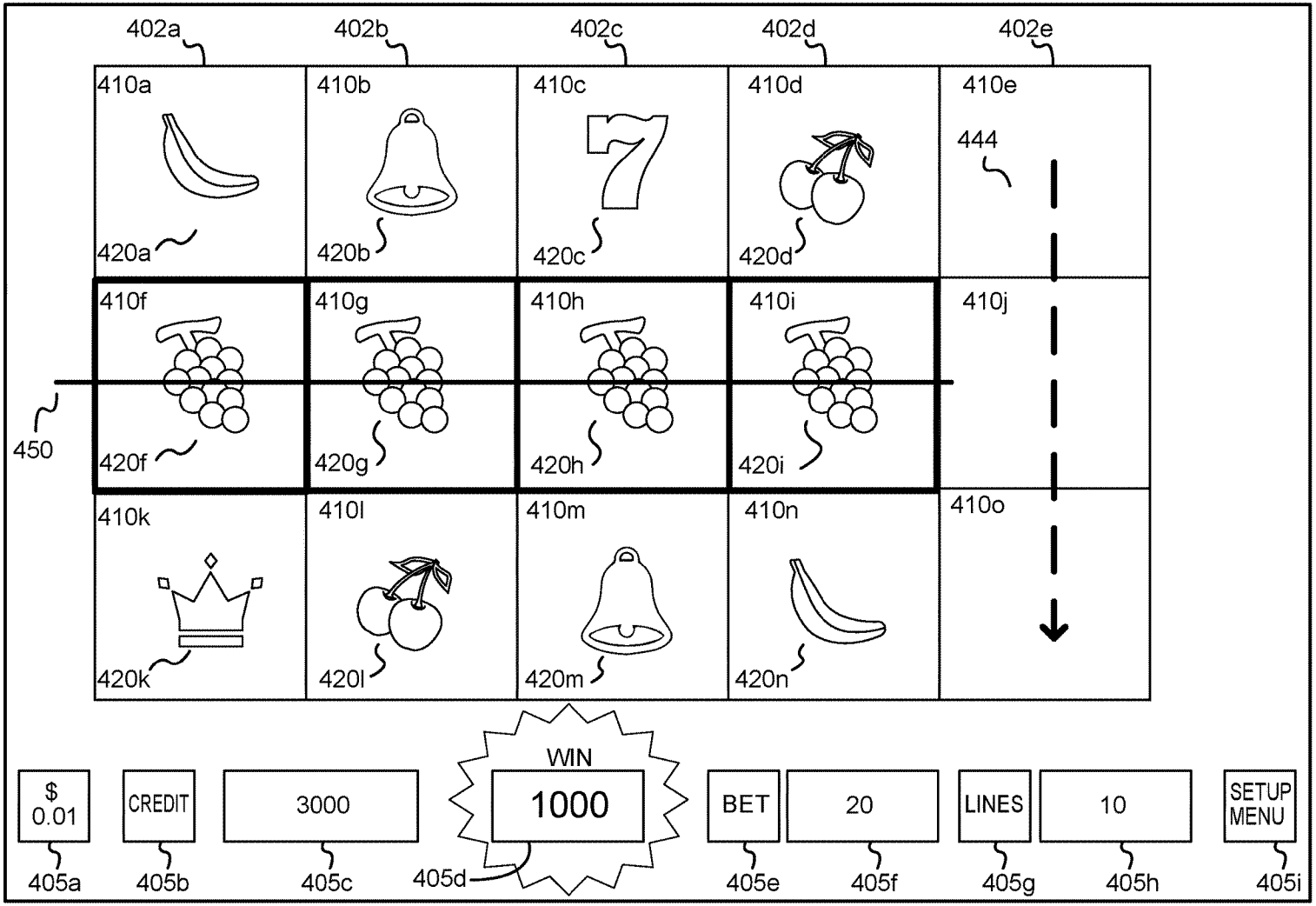

Returning to FIG. 4D, the gaming system determines that additional reels are still active and gaming system stops an additional reel. In this embodiment, the gaming system stops reel 402*d* from spinning and displays the generated symbols 420*d*, 420*i*, and 420*n* in symbol display areas 410*d*, 410*i*, and 410*n* for reel 402*d*. The gaming system also keeps reel 402*e* active and continues to show this reel spinning. As illustrated in FIG. 4D, the gaming system generated and displayed a Cherry symbol (420*d*), Grape symbol (420*i*), and a Banana symbol (420*n*) in the game display 400.

In one embodiment, the gaming system evaluates the generated symbols on reel 402*d* for winning symbol combinations based on the associated pay table in FIG. 5. For example, four Grape symbols along a pay line results in a winning symbol combination (e.g., 1000 credits) according to FIG. 5. The gaming system evaluates the generated and displayed symbols on reel 402*d* for winning symbols. In one such embodiment, because the gaming system already evaluated the symbols on reel 402*a*, reel 402*b*, and reel 402*c* the gaming system does not need to reevaluate the symbols for these reels. The gaming system may have already stored which symbols were generated for reel 402*a*, 402*b*, and 402*c* in memory. In some embodiments, the gaming system only stores winning symbols or representation of winning symbols in memory. In order to further save memory and processing cycles, the gaming system may also restrict the evaluation of symbol display areas to symbol display areas that could possibly result in a winning outcome with symbols from reels 402*a*, 402*b*, and 402*c*. In the embodiment shown in FIG. 4D, each of the symbols displayed along pay line 450 from reels 402*a*, reels 402*b*, and 402*c* may result in a winning outcome, while the other symbols in reels 402*a*, 402*b*, and 402*c* will not. Thus, the gaming system may restrict the evaluation of the symbols on reel 402*d* to the symbol 420*i* in symbol display area 410*i*. It should be appreciated that the gaming system may evaluate all of the displayed symbols on reels 402*a*, 402*b*, 402*c*, and 402*d* in other embodiments.

In FIG. 4D, the gaming system determined that four Grape symbols (420*f*, 420*g*, 420*h*, and 420*i*) were generated along an active (e.g., wagered) pay line 450. According to the pay table in FIG. 5, four Grape symbols along an active pay line results in a 1000 credit award. In one embodiment, if the gaming system determines that winning symbols were generated, the gaming system may highlight or otherwise call the player's attention to the winning symbols. As shown in FIG. 4D, the gaming system changed the borders around symbol display areas 410*f*, 410*g*, 410*h*, and 410*i* to highlight the winning symbols to the player. In one embodiment, the gaming system further updates the player win meter 405*d* to reflect the player's winning based on the generated symbols for reels 402*a*, 402*b*, 402*c*, and 402*d*. The gaming system may also highlight or otherwise call the player's attention to the award amount as shown by the flashing border around win meter 405*d*. However, the gaming system may not highlight the win meter 405*d* in some embodiments. In some embodiments, the gaming system may conspicuously display or flash the win amount to the player in other ways. For example, the gaming system may flash the win amount in the center of the game display 400 over the game screen image; provided however, the win amount may be provided to the player in any other suitable manner. The gaming system may also update the player's credit meter 405*c* to reflect the win amount. As shown in FIG. 4D, the player's credit meter 405*c* was incremented to 3000 to reflect the 1000 credit award for the four Grape symbols.

Figure 4E:
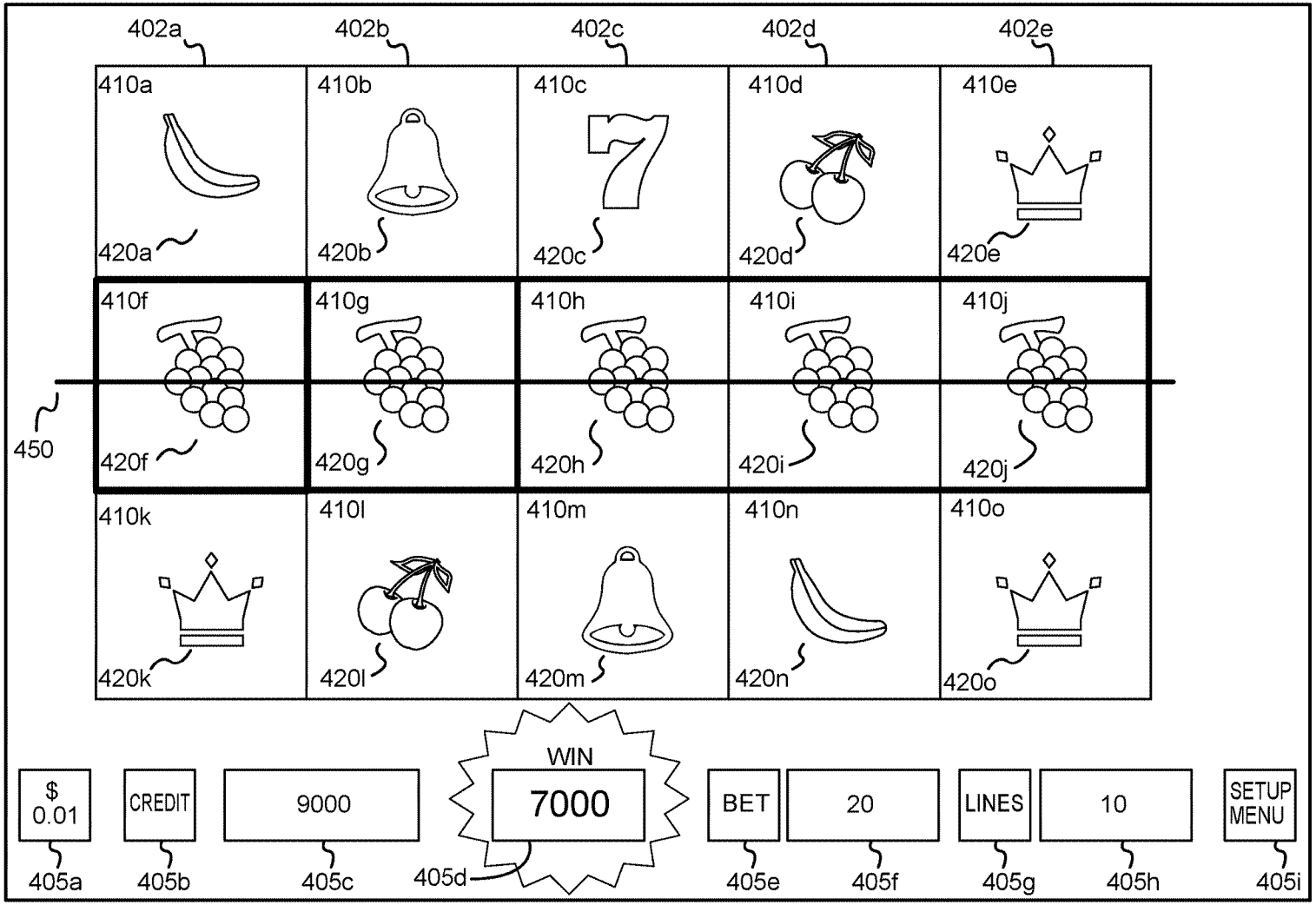
Figure 4E:
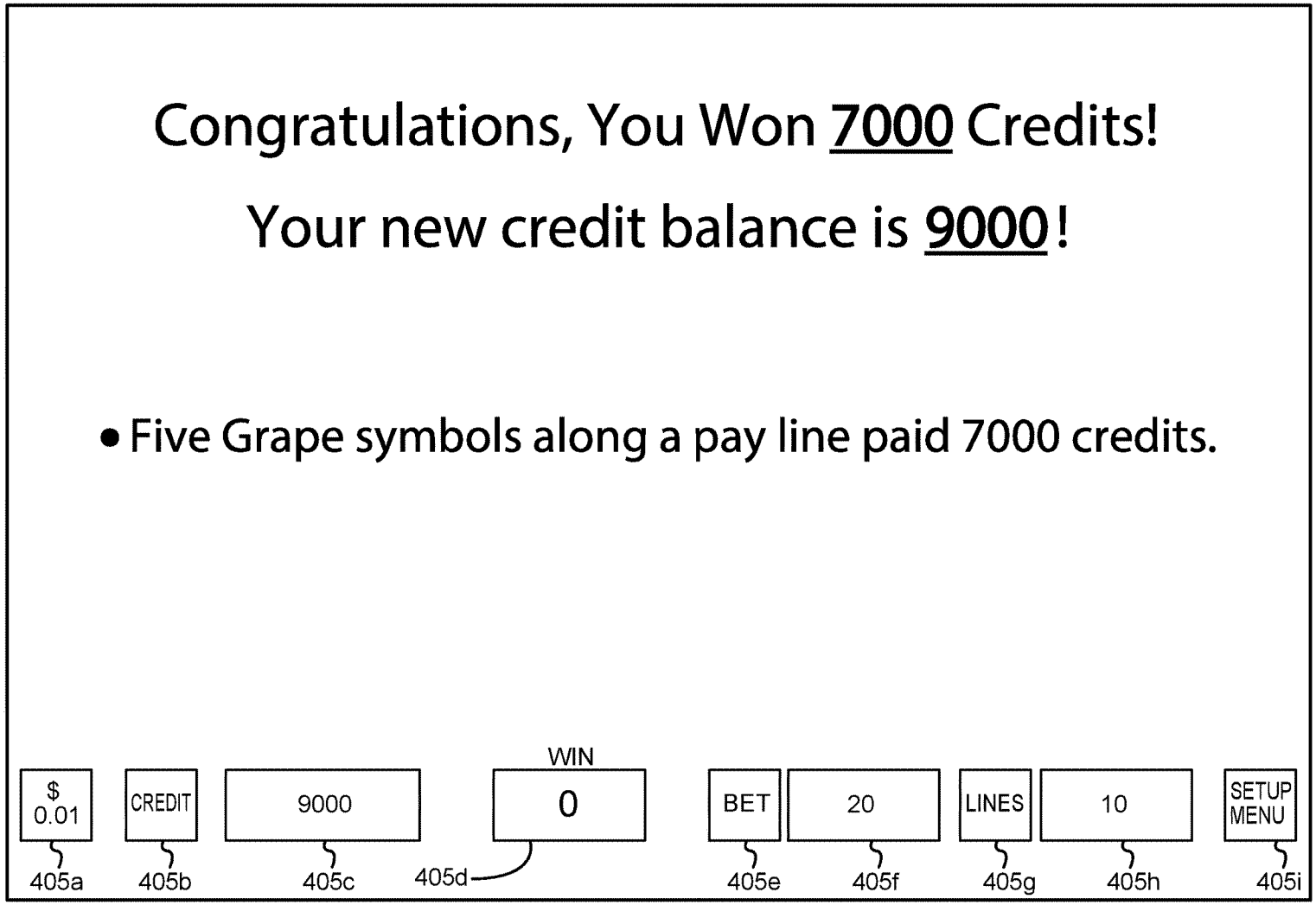

As illustrated in FIG. 4E, the gaming system determines that additional reels are still active and gaming system stops an additional reel. In this embodiment, the gaming system stops reel 402*e* from spinning and displays the generated symbols 420*e*, 420*j*, and 420*o* in symbol display areas 410*e*, 410*j*, and 410*o* for reel 402*e*. As illustrated in FIG. 4E, the gaming system generated and displayed a Crown symbol (420*e*), a Grape symbol (420*j*), and a Crown symbol (420*o*) in the game display 400.

In one embodiment, the gaming system evaluates the generated symbols on reel 402*e* for winning symbol combinations based on the associated pay table in FIG. 5. For example, five Grape symbols along a pay line results in a winning symbol combination (e.g., 7000 credits) according to FIG. 5. The gaming system evaluates the generated and displayed symbols on reel 402*e* for winning symbols. In one such embodiment, because the gaming system already evaluated the symbols on reel 402*a*, reel 402*b*, reel 402*c*, and reel 402*d* the gaming system does not need to reevaluate the symbols for these reels. The gaming system may have already stored which symbols were generated for reel 402*a*, 402*b*, 402*c*, and 402*d* in memory. In some embodiments, the gaming system only stores winning symbols or representation of winning symbols in memory. In order to further save memory and processing cycles, the gaming system may also restrict the evaluation of symbol display areas to symbol display areas that could possibly result in a winning outcome with symbols from reels 402*a*, 402*b*, 402*c*, and 402*d*. In the embodiment shown in FIG. 4E, each of the symbols displayed along pay line 450 from reels 402*a*, 402*b*, 402*c*, 402*d*, and 402*e* may result in a winning outcome, while the other symbols in reels 402*a*, 402*b*, 402*c*, 402*d*, and 402*e* will not. Thus, the gaming system may restrict the evaluation of the symbols on reel 402*e* to the symbol 420*j* in symbol display area 410*j*. It should be appreciated that the gaming system may evaluate all of the display symbols on reels 402*a*, 402*b*, 402*c*, 402*d*, and 402*e* in some embodiments.

In FIG. 4E, the gaming system determined that five Grape symbols (420*f*, 420*g*, 420*h*, 420*i*, and 402*j*) were generated along an active (e.g., wagered) pay line 450. According to the pay table in FIG. 5, five Grape symbols along an active pay line results in a 7000 credit award. In one embodiment, if the gaming system determines that winning symbols were generated, the gaming system may highlight or otherwise call the player's attention to the winning symbols. As shown in FIG. 4D, the gaming system changed the borders around symbol display areas 410*f*, 410*g*, 410*h*, 410*i*, and 410*j* to highlight the winning symbols to the player. In one embodiment, the gaming system further updates the player win meter 405*d* to reflect the player's winning based on the generated symbols for reels 402*a*, 402*b*, 402*c*, 402*d*, and 402*e*. The 7000 credit award replaced the player's prior award of 1000 credits. The gaming system may also highlight or otherwise call the player's attention to the award amount as shown by the flashing border around win meter 405*d*. However, the gaming system may not highlight the win meter 405*d* in some embodiments. In some embodiments, the gaming system may conspicuously display or flash the win amount to the player in other ways. For example, the gaming system may flash the win amount in the center of the game display 400 over the game screen image; however the win amount may be provided to the player in any other suitable manner. The gaming system may also update the player's credit meter 405*c* to reflect the win amount. As shown in FIG. 4E, the player's credit meter 405*c* was incremented to 9000 to reflect the 7000 credit award for the five Grape symbols.

As no reels remain active, the gaming system determines that the play of the game is over. Turning to FIG. 4F, the gaming system in one embodiment displays information regarding all of the game awards to the player. In this embodiment, the gaming system alerts the player that the player won 7000 credits during the play of the game and that the player's new credit balance is 9000. In some embodiments, the gaming system may break down how the player won the credits and additional free spins. For example, the gaming system may describe that the five Grape symbols along a pay line pays 7000 credits (e.g., based on the pay table illustrated in FIG. 5). It should also be appreciated that the award illustrated in FIG. 4F and FIG. 5 are merely illustrative and could be adjusted to include any suitable awards. In some embodiments, the gaming system does not update the player's credit balance meter until the play of the game is terminated.

The player may continue the gaming session by playing another game. That is, the player may place another wager and start a new play of the game. However, continued game play is dependent of the number of credits remaining in the player's credit balance. The player may also choose the cash out. In such an instance, the gaming system provides the player a value based on the player's credit balance using any of the value items discussed above (bills, coins, vouchers, etc.)

While FIG. 4A-4F illustrates the reels being stopped in a particular order, it should be appreciated that in some embodiments, the gaming system may stop and evaluate the reels in any suitable order. Thus, in some embodiments, the gaming system may stop reel 402*c* after stopping reel 402*a*. In yet other embodiments, the gaming system may stop reel 402*c* first before stopping a different active reel.

FIG. 5 illustrates a screen shot of one embodiment of a pay table for a game of the gaming system. As noted above, it should be appreciated that the pay table is merely illustrative, and the symbols, awards, and the credit values may all be modified in any suitable manner.

It should be appreciated that in some embodiments, the random generation of symbols for all reels may occur at substantially the same time as discussed above, while the gaming system incrementally displays and evaluates the symbols on each reel.

In still other embodiments, the gaming system generates and evaluates the generated symbols on each reel before revealing the generated symbol to the player. In one such embodiment, the gaming system reveals the generated symbols incrementally (e.g., one reel at a time).

It should be appreciated that a gaming system and method with incremental evaluation of symbol sets for winning symbol combinations increases the hardware efficiency of the gaming system. For example, processors of the gaming system process smaller quantities of data (e.g., evaluating symbols on each reel as the symbols are revealed) rather than processing all of the reels at once. The gaming system also does not need to load the entire set of generated symbols into memory at one time to perform a win evaluation, which reduces the amount of system memory that gaming system uses for a play of the game.

The incremental game evaluation also provides for shorter game evaluation processing at the end of a play of the game because the bulk of the game evaluation processing was already performed. The resulting play of the game ends sooner and the next play of the game can begin faster. Thus, the time between games is reduced and the overall rate of play on the gaming system can be increased. The more games that a gaming system can process in a day, the more cost effective the gaming system becomes for a gaming system operator.

Moreover, a gaming system and method with incremental evaluations of symbol sets for winning symbol combinations also builds a new sense of anticipation for a player as win amounts and quantities of winning symbols are accumulated over time. As a player obtains winning symbols with associated awards and reels remain active, the gaming system provides the player a greater sense of anticipation that each reel that remains active may produce a larger win and add to the players existing winnings.

A number of embodiments of the invention have been described. Various modifications may be made without departing from the spirit and scope of the invention. For example, various forms of the flows shown above may be used, with steps re-ordered, added, or removed. Accordingly, other embodiments are within the scope of the following claims.

We claim:

1. A gaming system comprising:

a cabinet;

a processor;

a display device supported by the cabinet;

an input device supported by the cabinet;

a value acceptor supported by the cabinet;

a value dispenser supported by the cabinet;

a memory device that stores a plurality of instructions which, when executed by the processor, cause the processor to:

establish a credit balance based at least in part on a monetary value received by the value acceptor;

place a wager following receipt of a wager input via an input device, the credit balance being decreased by the wager;

cause the display device to display a plurality of symbol display areas, where each symbol display area is associated with a set of symbols;

for each symbol display area, randomly generate a plurality of symbols from the associated set of symbols;

display, on the display device, a first plurality of randomly generated symbols in an associated first symbol display area;

evaluate the first plurality of randomly generated symbols for winning symbols;

determine a first credit award based on the first plurality of randomly generated symbols in the associated first symbol display area and the wager;

cause the display device to display the first credit award, the credit balance being increased by the first credit award;

display, on the display device, after displaying the first credit award, a second plurality of randomly generated symbols in an associated second symbol display area;

evaluate the second plurality of randomly generated symbols for winning symbols with the first plurality of randomly generated symbols;

determine a second credit award based on the second plurality of randomly generated symbols and the first plurality of randomly generated symbols and the wager;

cause the display device to display the second credit award, the credit balance being increased by the second credit award; and issue value from the value dispenser based on the credit balance upon receipt of a cash out signal via the input device.

2. The gaming system of claim 1, wherein the processor continues to display an additional plurality of randomly generated symbols, evaluate the additional plurality of randomly generated symbols, and determine an additional credit award associated with the additional plurality of randomly generated symbols until the processor displays generated symbols in all of the plurality of symbol display areas.

3. The gaming system of claim 1, wherein the random generation of the plurality of symbols for each symbol set occurs before any of the plurality of symbols are displayed.

4. The gaming system of claim 1, wherein the second plurality of randomly generated symbols is randomly generated after the first plurality of randomly generated symbols is displayed.

5. The gaming system of claim 1, wherein the randomly generated plurality of symbols for each symbol set are all evaluated before any of the randomly generated plurality of symbols are displayed.

6. The gaming system of claim 1, wherein the plurality of symbol display areas are reels.

7. The gaming system of claim 1, wherein the processor causes the display to highlight any evaluated winning symbols.

8. The gaming system of claim 1, wherein the processor increases a time it takes to display the second plurality of randomly generated symbols over the first plurality of randomly generated symbols.

9. The gaming system of claim 8, wherein the processor increases a second time it takes to display a third plurality of randomly generated symbols over the second plurality of randomly generated symbols.

10. The gaming system of claim 8, wherein a final time it takes to display a last plurality of randomly generated plurality of symbols over a second to last plurality of randomly generated plurality of symbols is longer than any time between other displayed randomly generated plurality of symbols.

11. The gaming system of claim 1, wherein the time between plays of a game is reduced.

12. The gaming system of claim 1, wherein the processor ends a game before displaying all of the randomly generated plurality of symbols for each symbol display area.

13. The gaming system of claim 1, wherein the processor enables a player to end a game before displaying all of the randomly generated plurality of symbols for each symbol display area.

14. The gaming system of claim 1, wherein the processor displays all of the randomly generated plurality of symbols, but ends a game without evaluating all of the randomly generated plurality of symbols.

15. A method of operating a gaming system, the method comprising:

receiving, by a monetary value acceptor, a monetary value;

establishing, by a processor of the gaming system, a credit balance based at least in part on the received monetary value;

accepting, from an input device in a housing of the gaming system, a wager amount;

decreasing, by the processor, the credit balance by the wager amount;

displaying, on a display device of the housing, a plurality of symbol display areas, where each symbol display area is associated with a set of symbols;

randomly generating a plurality of symbols from the associated set of symbols for each of the plurality of symbol display areas;

displaying, on the display device, a first plurality of randomly generated symbols in an associated first symbol display area;

evaluating the first plurality of randomly generated symbols for winning symbols;

determining a first credit award based on the first plurality of randomly generated symbols in the associated first symbol display area and the wager;

causing the display device to display the first credit award, the credit balance being increased by the first credit award;

displaying, on the display device, after displaying the first credit award, a second plurality of randomly generated symbols in an associated second symbol display area;

evaluating the second plurality of randomly generated symbols for winning symbols with the first plurality of randomly generated symbols;

determining a second credit award based on the second plurality of randomly generated symbols, the first plurality of randomly generated symbols, and the wager;

displaying, on the display device, the second credit award, the credit balance being increased by the second credit award; and issuing another monetary value, by the value dispenser, based on the credit balance upon receipt of a cash out signal via an input device of the gaming system.

16. The method of operating the gaming system of claim 15, further comprising continuing to display an additional plurality of randomly generated symbols, evaluate the additional plurality of randomly generated symbols, and determine an additional credit award associated with the additional plurality of randomly generated symbols until the randomly generated plurality of symbols are displayed in all of the plurality of symbol display areas.

17. The method of operating the gaming system of claim 15, wherein the random generation of the plurality of symbols for each symbol set occurs before any of the plurality of symbols are displayed.

18. The method of operating the gaming system of claim 15, wherein the second plurality of randomly generated symbols is randomly generated after the first plurality of randomly generated symbols is displayed.

19. The method of operating the gaming system of claim 15, wherein the randomly generated plurality of symbols for each symbol set are all evaluated before any of the plurality of symbols are displayed.

20. A non-transitory computer-readable storage medium having machine instructions stored therein, the instructions being executable by a processor to cause the processor to:

establish a credit balance based at least in part on a monetary value received by a value acceptor of a gaming device;

place a wager following receipt of a wager input via an input device, the credit balance being decreased by the wager;

display, on a display device of a housing, a plurality of symbol display areas, where each symbol display area is associated with a set of symbols;

randomly generate a plurality of symbols from the associated set of symbols for each of the plurality of symbol display areas;

display, on the display device, a first plurality of randomly generated symbols in an associated first symbol display area;

evaluate the first plurality of randomly generated symbols for winning symbols;

determine a first credit award based on the first plurality of randomly generated symbols in the associated first symbol display area and the wager;

cause the display device to display the first credit award, the credit balance being increased by the first credit award;

display, on the display device, after displaying the first credit award, a second plurality of randomly generated symbols in an associated second symbol display area;

evaluate the second plurality of randomly generated symbols for winning symbols with the first plurality of randomly generated symbols;

determine a second credit award based on the second plurality of randomly generated symbols, the first plurality of randomly generated symbols, and the wager;

display, on the display device, the second credit award, the credit balance being increased by the second credit award; and issue value from a value dispenser based on the credit balance upon receipt of a cash out signal via the input device.

* * * * *